US008552960B2

(12) United States Patent
Tsuchi

(10) Patent No.: US 8,552,960 B2
(45) Date of Patent: Oct. 8, 2013

(54) OUTPUT AMPLIFIER CIRCUIT AND DATA DRIVER OF DISPLAY DEVICE USING THE CIRCUIT

(75) Inventor: Hiroshi Tsuchi, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 488 days.

(21) Appl. No.: 12/899,149

(22) Filed: Oct. 6, 2010

(65) Prior Publication Data

US 2011/0080214 A1 Apr. 7, 2011

(30) Foreign Application Priority Data

Oct. 7, 2009 (JP) ..... 2009-233890

(51) Int. Cl.
*G09G 3/36* (2006.01)

(52) U.S. Cl.
USPC ..... 345/100

(58) Field of Classification Search
USPC ..... 345/100; 327/91, 307, 310; 330/9
See application file for complete search history.

(56) References Cited

U.S. PATENT DOCUMENTS

| | | | | |
|---|---|---|---|---|
| 6,448,836 | B2 * | 9/2002 | Kokubun et al. | 327/307 |
| 6,586,990 | B2 | 7/2003 | Udo et al. | |
| 2003/0034833 | A1 * | 2/2003 | Udo et al. | 330/9 |
| 2007/0035534 | A1 | 2/2007 | Yamazaki | |
| 2007/0236289 | A1 * | 10/2007 | Iriguchi | 330/253 |
| 2008/0074521 | A1 * | 3/2008 | Olsen | 348/300 |

FOREIGN PATENT DOCUMENTS

| | | |
|---|---|---|
| JP | 2003-60453 A | 2/2003 |
| JP | 2007-47342 A | 2/2007 |

* cited by examiner

*Primary Examiner* — Chanh Nguyen
*Assistant Examiner* — Jonathan Blancha
(74) *Attorney, Agent, or Firm* — Sughrue Mion, PLLC

(57) ABSTRACT

An output amplifier includes a differential stage having a reference voltage supplied to a first input, a first output stage that receives an output of the differential stage, a second output stage whose output is connected to a load, a capacitor element having a first end connected to a second input of the differential stage, and connection control circuits that control switching of first and second connection modes. In the first connection mode, there are provided a non-conductive state between output of the differential stage and input of the second output stage, a non-conductive state between output of the first output stage and output of the second output stage, a conductive state between output of the first output stage and the second input of the differential stage, and voltage of a second end of the capacitor element is an input voltage from the input terminal. In the second connection mode, there are provided a conductive state between output of the differential stage and input of the second output stage, a conductive state between output of the first output stage and output of the second output stage; a non-conductive state between output of the first output stage and the second input of the differential stage, a non-conductive state of the second end of the capacitor element from the input terminal, and a conductive state between the output of the first output stage and the second end of the capacitor element.

20 Claims, 16 Drawing Sheets

FIG. 16

RELATED ART

| | OFFSET CANCEL TIME INTERVAL | AMPLIFIER OPERATION TIME INTERVAL |
|---|---|---|
| SW1、SW3 | ON | OFF |
| SW2、SW4 | OFF | ON |
| M13、M15 | ON | OFF |
| M14、M16 | OFF | ON |
| SECOND OUTPUT STAGE | ACTIVE | NON-ACTIVE |

OUTPUT AMPLIFIER CIRCUIT AND DATA DRIVER OF DISPLAY DEVICE USING THE CIRCUIT

REFERENCE TO RELATED APPLICATION

This application is based upon and claims the benefit of the priority of Japanese patent application No. 2009-233890, filed on Oct. 7, 2009, the disclosure of which is incorporated herein in its entirety by reference thereto.

TECHNICAL FIELD

The present invention relates to an output amplifier circuit and to a data driver of a display device using the circuit.

BACKGROUND

Recently, there is an increasing demand for liquid crystal display devices as large screen liquid crystal TVs, in addition to portable telephone terminals (mobile phone, cell phone), notebook PCs, and monitors. In these liquid crystal display devices, a liquid crystal display device of an active matrix drive system that enables a high-definition display is used. First, referring to FIG. 12, an outline is given concerning a typical configuration of a liquid crystal display device that uses the active matrix drive system. It is to be noted that in FIG. 12, a main configuration connected to one pixel of a liquid crystal unit is schematically shown by an equivalent circuit.

In general, a display panel 960 of the liquid crystal display device of the active matrix drive system includes a semiconductor substrate on which transparent pixel electrodes 964 and thin film transistors (TFTs) 963 are arranged in a matrix (for example, in a case of a color SXGA panel, 1280×3 pixel columns×1024 pixel rows), and an opposing substrate that has a transparent electrode 967 formed on an entire surface, and a liquid crystal sealed between with these two substrates which face to each other. It is to be noted that a display element 969 corresponding to one pixel is provided with a pixel electrode 964, an opposing substrate electrode 967, a liquid crystal capacitor 965, and auxiliary capacitor 966.

The TFT 963 which has a switching function, is controlled to be ON/OFF (conductive/non-conductive) by a scan signal. When the TFT 963 is ON (conductive), a gray scale signal voltage corresponding to a video data signal is applied to the pixel electrode 964 of the display element 969, and liquid crystal transmittance changes according to potential difference between each pixel electrode 964 and the opposing substrate electrode 967. After the TFT 963 is turned OFF (non-conductive), an image is displayed by holding the potential difference for a fixed time period by the liquid crystal capacitor 965, and the auxiliary capacitor 966.

On a semiconductor substrate, a data line 962 that transmits plural level voltages (gray scale signal voltages) applied to each pixel electrode 964, and a scan line 961 that transmits a scan signal are laid out in a grid form (in a case of the abovementioned color SXGA panel, there are 280×3 data lines and 1024 scan lines). The scan line 961 and the data line 962 form large capacitive loads, due to capacitance at an intersection thereof and capacitance of the liquid crystal sandwiched between the opposing substrate electrodes.

It is to be noted that the scan signal is supplied to the scan line 961 from a gate driver 970, and that the supply of gray-scale signal voltage to each pixel electrode 964 is performed by a data driver 980 via the data line 962. The gate driver 970 and the data driver 980 are controlled by a display controller 950, and supplied with respectively required clocks CLK and control signals by the display controller 950. Video data is supplied to the data driver 980. At present, digital data is used as video data. A power supply circuit 940 supplies a required power supply voltage respective drivers.

Rewriting of one screen of data is carried out over one frame time period (normally about 0.017 seconds when driving at 60 Hz), a selection is successively made every pixel row (every line) by each scan line, and a gray-scale signal voltage is supplied by each data line within a selection time period. It is to be noted that a plurality of pixel rows may be selected by a scan line at the same time, and driving may be performed with a frame frequency of 60 Hz or more.

Although the gate driver 970 only needs to be supplied with at least a binary scan signal, the data driver 980 is required to drive the data line by gray scale signal voltage of multi-value levels in accordance with the number of gray scale levels. As a result, the data driver 980 is provided with a digital-to-analog converter circuit (DAC) including a decoder that converts video data to analog voltage, and an output amplifier that amplifies and outputs the analog voltage to the data line 962.

For a drive method of driving a large screen display device such as a monitor, liquid crystal TV and so forth, a dot inversion driving system that enables high image quality is employed. The dot inversion driving system, in the display panel 960 of FIG. 12, is a drive system in which the opposing substrate electrode voltage VCOM is a constant voltage, and voltage polarities held in neighboring pixels have mutually opposite polarity. As a result, the voltage polarity outputted to neighboring data lines (962) forms a positive polarity and a negative polarity with respect to the opposing substrate electrode voltage VCOM. It is to be noted that in the dot inversion driving, normally, polarity inversion of data lines is carried out for each one horizontal time period, but in a case of an increase in data line load capacitance or when frame frequency becomes high, a dot driving method in which polarity inversion is performed for each two horizontal time periods is also used.

FIG. 13A is a diagram showing a configuration of an output amplifier circuit (output circuit) for a data driver that drives a data line (refer to Patent Document 1 and the like). FIG. 13B is a timing diagram for describing operation of FIG. 13A.

The output amplifier circuit includes a differential stage 900 having a non-inverting input terminal connected to an input terminal N1; a pMOS transistor M93 having a source connected to a first power supply terminal (VDD), a gate connected to first output of the differential stage 900, and a drain connected to an output terminal N3; and a nMOS transistor M94 having a source connected to a second power supply terminal (VSS), a gate connected to second output (a common phase signal with respect to the first output is outputted) of the differential stage 900, and a drain connected to the output terminal N3; and the output terminal N3 is connected to an inverting input terminal of the differential stage 900. An output switch SW90 (transfer gate) is provided between the output terminal N3 of the output amplifier circuit and a load (data line) 90.

With regard to the output switch SW90, transition noise at a point in time of change of an input signal (analog data) applied to the input terminal N1 is amplified by the output amplifier circuit to be transmitted to the load (data line) 90, and in order to prevent display deterioration, for a prescribed time period (T11) from the start of one data time period, control is usually performed so that the output switch SW90 is turned OFF. In the prescribed time period (T11) in FIG. 13B, the analog data signal finishes a transitioning, in an output time period (T12), the output switch SW90 is ON, and the load (data line) 90 is driven by a gray scale signal voltage outputted from the output amplifier circuit, in response to an input signal Vin.

FIG. 14 is a diagram showing a configuration example of the differential stage 900 of FIG. 13A at a transistor level, which has a folded cascode Rail-to-Rail amplifier configuration, provided with both an nMOS differential pair and a pMOS differential pair. The differential stage 900 is provided with a nMOS differential pair (M11 and M12) and a pMOS differential pair (M21 and M23), driven by first and second current sources (M13 and M23), respectively and a first cascoded current mirror circuit (M14 to M17). The nMOS and pMOS differential pairs have first inputs connected to an input terminal (1), and second inputs connected to an output terminal (2). An output pair of the nMOS differential pair is connected to the first cascoded current mirror circuit (M14 to M17). The differential stage 900 is also provided with a first floating current source (M31 and M32) and a second floating current source (M32 and M34) connected to first and second terminals of the first cascoded current mirror circuit and a second cascoded current mirror circuit (M24 to M37) having first and second terminals respectively connected to a second end of the first and second floating current sources and connected to an output pair of the pMOS differential pair. The second terminals of the first and second cascoded current mirror circuits form first and second outputs of the differential stage 900.

In more detail, referring to FIG. 14, the differential stage 900 includes:

an nMOS transistor M13 (constant current source) having a source connected to a power supply VSS, and a gate connected to a bias terminal BN1;

nMOS transistors M11 and M12 (nMOS differential pair) having coupled sources connected to a drain of the nMOS transistor M13, and gates connected to an input terminal 1 and an output terminal 2, respectively;

a pMOS transistor M23 (constant current source) having a source connected to a power supply VDD and a gate connected to a bias terminal BP1;

pMOS transistors M21 and M22 (pMOS differential pair) having coupled sources connected to a drain of the pMOS transistor M23, and gates connected to an input terminal 1 and an output terminal 2, respectively;

pMOS transistors M14 and M15 having sources connected to the power supply VDD, and gates coupled together;

pMOS transistors M16 and M17 having sources connected to drains of the pMOS transistors M14 and M15, respectively, and gates coupled together to a bias terminal BP2;

nMOS transistors M24 and M25 having sources connected to the power supply VSS, and gates coupled together; and nMOS transistors M26 and M27 having sources connected to drains of the nMOS transistors M24 and M25, respectively, and gates coupled together to the bias terminal BN2.

The drains (output of the nMOS differential pair) of the nMOS transistors M11 and M12 are connected to drains of the pMOS transistors M14 and M15 (load circuit of the nMOS differential pair), respectively. The drains (output of the pMOS differential pair) of the pMOS transistors M21 and M22 are connected to drains of the nMOS transistors M24 and M25 (load circuit of the pMOS differential pair), respectively. The drain of the pMOS transistor M17 is connected to common gates of the pMOS transistors M14 and M15. The pMOS transistors M14 to M17 form the first cascoded current mirror. The drain of the nMOS transistor M27 is connected to coupled gates of the nMOS transistors M24 and M25. The transistors M24 to M27 form the second cascoded current mirror.

The differential stage 900 includes:

an nMOS transistor M32 and a pMOS transistor M31 connected in parallel between the drain of the pMOS transistor M17 and the drain of the nMOS transistor M27, and an nMOS transistor M34 and a pMOS transistor M33 connected in parallel between the drain of the pMOS transistor M16 and the drain of the nMOS transistor M26. The gate of the pMOS transistor M31 is connected to a bias terminal BP3, the gate of the nMOS transistor M32 is connected to the bias terminal BN3, the gate of the pMOS transistor M33 is connected to a bias terminal BP4, and the gate of the nMOS transistor M34 is connected to the bias terminal BN4. The pMOS transistor M31, the nMOS transistor M32, the pMOS transistor M33, and the nMOS transistor M34 respectively form floating current sources.

A capacitor C3 (phase compensation capacitor) is inserted between the output terminal 2 and a connection node of the pMOS transistor M14 and M16, that is, an output of the nMOS differential pair), and a capacitor C4 is connected between the output terminal 2 and a connection node of the nMOS transistors M24 and M26, that is an output of the pMOS differential pair.

An output stage 110 includes:

a pMOS transistor M93 having a source connected to the power supply VDD and a gate connected to a drain of the pMOS transistor M16 (the second terminal of the first cascoded current mirror circuit), and an nMOS transistor M94 having a source connected to the power supply VSS and a gate connected to a drain of the nMOS transistor M26 (the second terminal of the second cascoded current mirror circuit). A connection node of drains of the pMOS transistor M93 and the nMOS transistor M94 forms an output node 2 which is connected to a gate of the nMOS transistor M12 of the nMOS differential pair and a gate of the pMOS transistor M22 of the pMOS differential pair. The differential stage 900 and an output stage 100 in FIG. 14 form a voltage follower.

Patent Document 2 discloses a configuration of an offset cancelling amplifier as shown in FIG. 15. Referring to FIG. 15, a differential circuit 10 includes nMOS transistors M3 and M4 forming a differential pair with sources being commonly connected, an nMOS transistor M9 (current source) connected to the coupled sources of the nMOS transistors M3 and M4, and pMOS transistors M1 and M2 having drains connected to drains of the nMOS transistors M3 and M4, respectively and forming a current mirror circuit. There is provided a pMOS transistor M7 having a source connected to a power supply terminal VDD and a gate connected to the drain of the nMOS transistor M4, and a drain N1 fed back to a gate of the transistor M3 via a switch SW2;

an nMOS transistor M10 (a pull-down current source transistor) having a source connected to a power supply terminal GND, and a drain connected to the drain N1 of the pMOS transistor M7, and a gate supplied with a bias voltage VBB;

a pMOS transistor M11 having a source connected to the power supply terminal VDD and a drain connected to an output terminal OUT;

an nMOS transistor M12 having a source connected to a power supply terminal VSS and a drain connected to the output terminal OUT;

a pMOS transistor M13 connected between a gate of the transistor M7 and a gate of the transistor M11, and having a gate connected to a control signal CON;

a nMOS transistor M15 connected between a gate of the transistor M12 and a gate of the transistor M10, and having a gate connected to an inverted signal (output of an inverter INV2) of the control signal CON;

a pMOS transistor M14 having a source connected to a power supply terminal VDD, a drain connected to a gate of the transistor M11, and a gate supplied with a signal obtained by inverting the control signal CON by an inverter INV1; and an nMOS transistor M16 having a source connected to a power supply terminal GND, a drain connected to a gate of the transistor M12, and a gate supplied with a signal obtained by inverting the control signal CON by the inverter INV2 and further inverted by an inverter INV3.

An offset cancel circuit 11 that stores an offset state is connected to the transistors M3 and M4 composing an input stage differential pair. The offset cancel circuit 11 stores a voltage (IN+ΔV) obtained by an offset voltage ΔV being added to an input voltage IN.

The offset cancel circuit 11 includes transistors M5 and M6 (nMOS) for offset cancellation in parallel to the differential pair transistors M3 and M4, a current source transistor M8 (nMOS) connected to the coupled sources of the transistors M5 and M6; and a capacitor C1 for offset cancellation connected to a gate of the transistor M5. A prescribed bias voltage VBB is applied to gates of the three current source transistors M8, M9, and M10.

In an offset cancel time period, the switch SW2 is turned OFF (non-conductive), switches SW1 and SW3 are turned ON (conductive), and the input voltage IN is applied to gates of the transistors M3, M4, and M6. At this time, a gate N2 of the transistor M5 in the offset cancel circuit 11, with a drain N1 of the transistor M7 being fed back via the switch SW3, has a voltage follower configuration with respect to the input voltage IN. As a result, a voltage (IN+ΔV) obtained by the offset voltage ΔV being added to the input voltage IN is stored in the capacitor C1.

Thereafter in an operational amplifier operation time period, the switch SW2 is turned ON, the switches SW1 and SW3 are turned OFF, and the drain N1 of the output transistor M7 is fed back to a gate of the transistor M3. In the offset cancel circuit 11, voltages of the gates of the transistors M5 and M6 are maintained. As a result, the gate of the transistor M3 is stable in a state having the input voltage IN and at the drain N1 of the transistor M7, the input voltage IN is generated.

In addition, the transistor M11 (pMOS) and the transistor M12 (pMOS) (second output stage) are connected in parallel with the transistor M7 and the transistor M10 (first output stage), the switch transistors M13 and M14 (both pMOS) are connected to a gate of the transistor M11, and the switch transistors M15 and M16 (both nMOS) are connected to a gate of the second output current source transistor M12. These switch transistors M12, M14, M15, and M16 are controlled to be turned ON and OFF by the control signal CON and its inverted controls by the inverters INV1, 2, and 3.

In this operational amplifier circuit, when an offset cancel time period is finished, the transistor M11 and the transistor M12 are cut off from the transistor M7 and the transistor M10, and the gates if the transistor M11 and the transistor M12 are connected to the power supply VDD and ground GND, respectively to be set in a non-operation state. That is, by switching the control signal CON from a Low level to a High level, both of the transistors M13 and M15 are turned OFF, and both of the transistors M14 and M16 are turned ON. Then after, a switch SW4 is turned ON to enter an operational amplifier operation time period. As a result, in the operational amplifier operation time period thereafter, a control operation according to an output of the differential circuit 10 with regard to the transistor M11 is stopped, and the transistor M11 is in a non-active state. The output current source transistor M12 similarly is in a non-active state.

FIG. 16 is a diagram showing operation of an output unit of a circuit in FIG. 15. In the offset cancel time period, the switches SW2 and SW4 are OFF, the switches SW1 and SW3 are ON, the transistors M13 and M15 are ON, the transistors M14 and M16 are OFF, and the second output stage (M11 and M12) is activated. The drain node N1 of the output transistor M7 is driven by a voltage that is offset by an offset voltage ΔV from the input voltage IN, and the capacitor C1 is charged by an input voltage of IN+ΔV. In the operational amplifier operation time period, the switches SW2 and SW4 are ON, the switches SW1 and SW3 are OFF, and the second output stage (M11 and M12) is in a non-activated state. The second output stage (M11 and M12) is activated in the offset cancel time period, and signals that are the same as those supplied to respective gates of the first output stage (M7 and M10) are supplied to respective gates of the second output stage (M11 and M12). In this way, by a load capacitor (not shown in the drawing) that is connected to the output terminal OUT being driven as far as approximately the input voltage IN by the second output stage (M11 and M12) in the offset cancel time period, it is possible to speed up the drive speed of the load capacitor (improve the response characteristic of the output voltage). With regard to the final load capacitor drive voltage (output voltage), the voltage (IN), in which the offset voltage ΔV is cancelled is outputted from the first output stage (M7 and M10) in the operating amplifier operation time period.

[Patent Document 1]

JP Patent Kokai Publication No. JP-P2007-47342A

[Patent Document 2]

JP Patent Kokai Publication No. JP-P2003-60453A

SUMMARY

The entire disclosures of Patent Documents 1 and 2 are incorporated herein by reference thereto.

The following analysis is given by the present invention.

Data line load is increasing due to increased sizes of liquid crystal TVs, and there is also a tendency for shortening of data drive time due to high definition. Improvement of load drive speed of drivers and lower power consumption is being demanded.

In a case of driving a large size high definition LCD panel by an output amplifier circuit as in FIG. 13, the capacitance of the load 90 increases, and one data period becomes short.

As a result, there is a concern of insufficiency of drive speed with respect to the load capacitance due to an ON resistance of an output switch SW90.

Since charging and discharging is carried out via the output switch SW90, power consumption and heat generation also increase due to an ON resistance of the output switch SW90. In order to decrease the ON resistance of the output switch SW90, it is necessary to enlarge the size of the output switch SW90, thereby resulting in an area increase.

On the other hand, in a case of driving a large size high definition LCD panel by an offset cancelling amplifier, it is possible to drive by a high accuracy output voltage where offset voltage is cancelled, but with an offset cancel time period being necessary, an operational amplifier operation time period for actually driving the load capacitance may become short, and the drive speed may be insufficient.

In the offset cancelling amplifier of FIG. 15, it is possible to drive the load capacitance by a second output stage (M11 and M12) also in the offset cancel time period, but sufficient drive capability with regard to a large load capacitance cannot be obtained. The reason for this is described below.

In the offset cancel time period, a first output stage (M7 and M10), being cut off from the load capacitance (SW4 is OFF), drives a capacitor C1. The capacitor C1 may hold a voltage including an offset voltage ΔV. In order to prevent an increase in an amplifier area, the capacitor C1 may be configured with a small capacitance value. Therefore, the drive capability of the first output stage (M7 and M10) in the offset cancel time period is only a capability to be able to charge and discharge the capacitor C1.

As a result, change of voltage applied to respective gates (increase in gate-to-source voltage) of the first output stage (M7 and M10) is small.

Since voltages supplied to respective gates of a second output stage (M11 and M12) are the same as voltages applied to respective gates of the first output stage (M7 and M10), sufficient driving capability with respect to a large load capacitance is not obtained, and there is no contribution to improvement in drive speed.

Accordingly, it is an object of the present invention to enable improvement in drive speed in an output amplifier circuit in which an output offset is corrected and high accuracy output is possible, and to provide an output amplifier circuit that enables reduction of power consumption, and a data driver of a display device using the circuit.

The present invention may be configured generally as follows, although not limited thereto.

According to the present invention, there is provided an output amplifier circuit including:

an input terminal that receives an input voltage;

a differential stage having an input pair with a first input thereof supplied with a reference voltage and a second input and having first and second outputs;

a first output stage having first and second inputs connected to the first and second outputs of the differential stage, respectively;

a second output stage having an output connected to a load and having first and second inputs;

a capacitor element having a first end connected to the second input of the input pair of the differential stage; and a control circuit that controls switching between a first connection mode and a second connection mode. The control circuit controls such that in the first connection mode, there are set a non-conductive state between the first and second outputs of the differential stage and the first and second inputs of the second output stage;

a non-conductive state between an output of the first output stage and the output of the second output stage;

a conductive state between the output of the first output stage and the second input of the differential stage; and a conductive state between a second end of the capacitor element and the input terminal, the second end of the capacitor being supplied with the input voltage from the input terminal, and in the second connection mode, there are set a conductive state between the first and second outputs of the differential stage and the first and second inputs of the second output stage;

a conductive state between the output of the first output stage and the output of the second output stage;

a non-conductive state between the output of the first output stage and the second input of the differential stage;

a non-conductive state between the second end of the capacitor element and the input terminal; and a conductive state between the output of the first output stage and the second end of the capacitor element.

According to the present invention, there are provided: a data driver provided with the output amplifier circuit and a display device.

According to the present invention, in an amplifier with an output offset correction and high accuracy output, it is possible to realize an improvement in drive speed, and to realize a reduction in power consumption.

Still other features and advantages of the present invention will become readily apparent to those skilled in this art from the following detailed description in conjunction with the accompanying drawings wherein only exemplary embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

FIG. 16 is a diagram describing operation of a circuit of FIG. 15.

PREFERRED MODES

Figure 1:
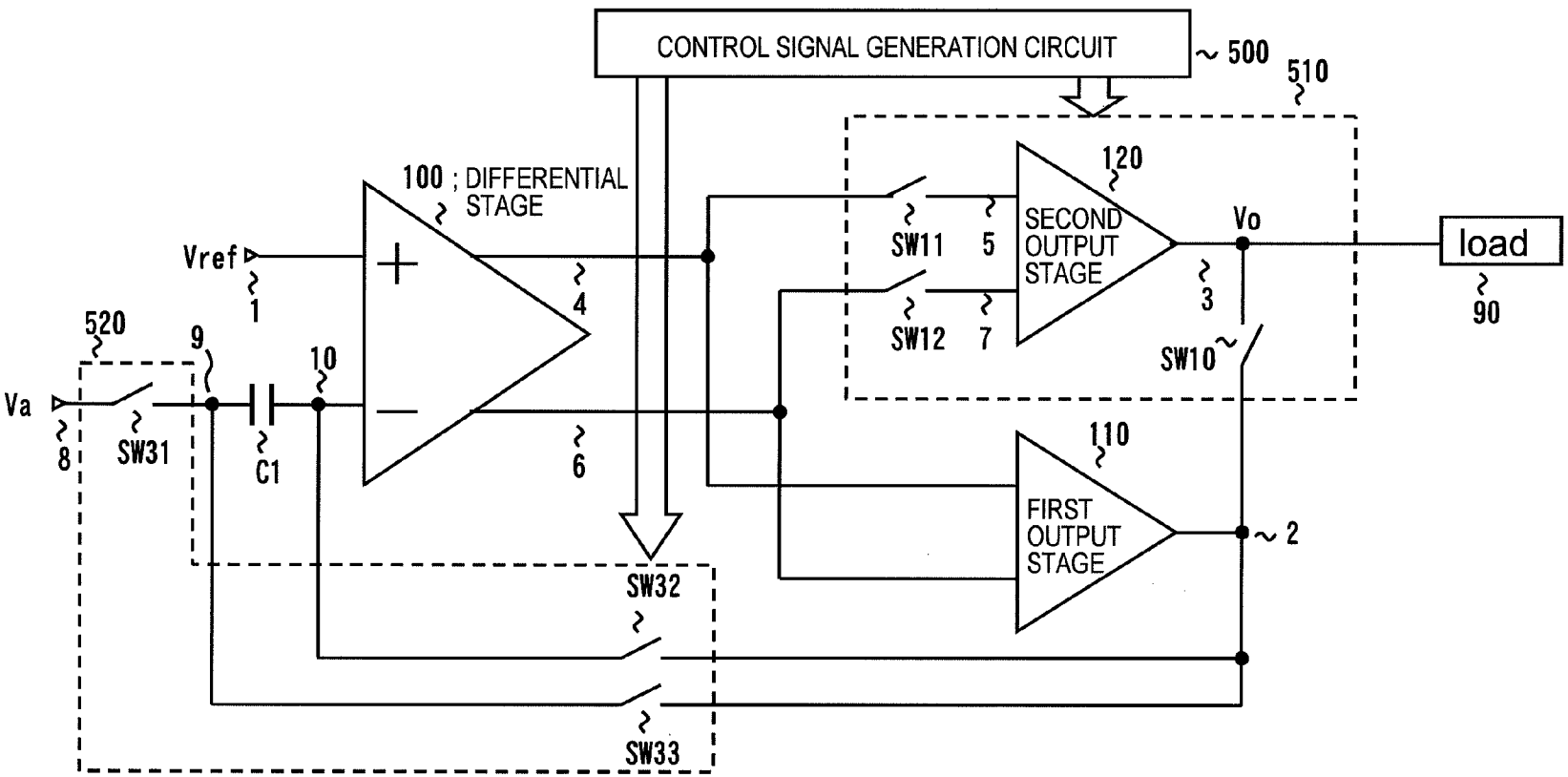
FIG. 1 is a diagram showing a configuration of an exemplary embodiment of the present invention.

Exemplary embodiments of the present invention will be described in the below. An output amplifier circuit in accordance with one of modes of the present invention, includes an input terminal (8) that receives an input voltage (Va), a differential stage (100) that has a first input (1) supplied with a reference voltage (Vref) and a second input (10) and first and second outputs (4 and 6), a first output stage (110) that has first and second inputs connected to the first and second outputs (4 and 6) of the differential stage (100), a second output stage (120) that has an output (3) connected to a load (90) and first and second inputs (5 and 7), a capacitor element (C1) that has a first end connected to a second input (10) of the differential stage (100), and a control circuit (500, 510, and 520) that controls switching of first and second connection modes.

In the first connection mode, a control circuit perform control so that switches (SW11 and SW12) are turned OFF to have a non-conductive state between the first and second outputs (4 and 6) of the differential stage (100) and the first and second inputs (5 and 7) of the second output stage (120), respectively;

a switch (SW10) is turned OFF to have a non-conductive state between output (2) of the first output stage (110) and output (3) of the second output stage (120);

a switch (SW32) is turned ON to have a conductive state between output (2) of the first output stage (110) and the second input (10) of the differential stage (100); and a switch (SW31) is turned ON to supply the input voltage (Va) from the input terminal (8) to a second end (9) of the capacitor element (C1). A switch (SW33) between the output (2) of the first output stage (110) and the second end (9) of the capacitor element (C1) is turned OFF.

In the second connection mode, a control circuit controls so that switches (SW11 and SW12) are turned ON to have a conductive state between the first and second outputs (4 and 6) of the differential stage (100) and the first and second inputs (5 and 7) of the second output stage (120), respectively;

a switch (SW10) is turned ON to have a conductive state between output (2) of the first output stage (110) and output (3) of the second output stage (120);

a switch (SW32) is turned OFF to have a non-conductive state between output (2) of the first output stage (110) and the second input (10) of the differential stage (100);

a switch (SW31) is turned OFF to have a non-conductive state between the second end (9) of the capacitor element (C1) and the input terminal (8); and a switch (SW33) is turned ON to have a conductive state between the output (2) of the first output stage (110) and the second end (9) of the capacitor element (C1).

A time period necessary for receiving an input voltage in response to one item of data and driving the load has a first time interval (T1) and a second time interval (T2) succeeding this. In the first time interval (T1), with the first connection mode, the first output stage (110) is activated, the switches (SW10, SW11, and SW12) are turned OFF (non-conductive), and an output node (2) of the first output stage (110) is cut off from the load (90).

In the first time interval (T1), the differential stage (100) and the first output stage (110) are made to operate, the switch (SW31) is turned ON (conductive), the switch (SW32) is turned ON (conductive), the switch (SW33) is turned OFF (non-conductive), electric charge corresponding to a voltage difference {Va−(Vref+Voff)} between a voltage (Vref+Voff) (voltage at a node 10) obtained by adding an output offset (Voff) to the voltage (Vref) at the first input terminal (1), and the input voltage (Va) at the input terminal (8), is stored in the capacitance element (C1).

In the second time interval (T2), being set in the second connection mode, the switches (SW11 and SW12) are turned ON (conductive), the first and second inputs (5, 7) of the second output stage (120) are connected to the first and second outputs (4 and 6) of the differential stage (100), respectively, the second output stage (120) is activated, the switch (SW10) is turned ON (conductive), the load (90) is connected to the output node (2) of the first output stage (110), and driving is performed by the first output stage (110) and the second output stage (120). In the second time interval (T2), the switch (SW32) and the switch (SW31) are turned OFF (non-conductive), and the switch (SW33) is turned ON (conductive). Since the switch (SW31) is OFF (non-conductive), the second end (9) of the capacitor element (C1) is cut off from the input terminal (8), and there is a voltage corresponding to a voltage obtained by adding the voltage (Vref+Voff) of the terminal (10) before the switch (SW32) is turned OFF, to a voltage across terminals {Va−(Vref+Voff)} of the capacitor element (C1) (therefore, the input voltage (Va)). A voltage (Vo) at an output node (3) connected to the output node (2) of the first output stage (110) is a voltage corresponding to a voltage (Va) with no output offset.

In the present invention, when the output voltage (Vo) reaches the voltage (Va), the second output stage (120) may have a configuration where operation is stopped. A setting may be arranged such that an absolute value of a threshold voltage of an output transistor (not shown in the drawing) of the second output stage (120) is larger than an absolute value of a threshold voltage of an output transistor (not shown in the drawings) of the first output stage (110). Alternatively, an output signal of the first output stage (110) may undergo a level shift to be supplied as an input signal of the output transistor of the second output stage (120). Alternatively, there may be built in the second output stage (120), a circuit which, when the output voltage reaches an input voltage, makes the second output stage (120) non-active with peak detection or the like.

According to the present invention, the drive speed of the load (90) is improved by the second output stage (120) that is not affected by an ON resistance of the output switch (SW10), and also the power consumption is reduced (an amount of power consumed by the ON resistance of the output switch is reduced) because a drive current that drives the load (90) via the output switch (SW10) is reduced. A high accuracy voltage output, in which an output offset is cancelled, is made possible.

FIRST EXEMPLARY EMBODIMENT

FIG. 1 is a diagram showing a configuration of an exemplary embodiment of an output amplifier circuit according to the present invention. Referring to FIG. 1, in the present exemplary embodiment there are provided a differential stage 100, a first output stage 110, a second output stage 120, switches SW11 and SW12 connected between first and second outputs 4 and 6 of the differential stage 100 and first and second inputs of the second output stage 120, respectively, a switch SW10 connected between an output node 2 of the first output stage 110 and an output node 3 of the second output stage 120, a switch SW31 connected between an input terminal 8 and a node 9, a capacitor C1 connected between the node 9 and an inverting input terminal 10 of the differential stage 100, a switch SW32 connected between the output node 2 of the first output stage 110 and the inverting input terminal 10 of the differential stage 100, a switch SW33 connected between the output node 2 of the first output stage 110 and the node 9, and a control signal generation circuit 500 that generates a control signal which performs ON/OFF control of a switch. It is to be noted that the differential stage 100 includes at least a constant current source, a differential pair, and a load circuit. In an output amplifier circuit provided with an intermediate stage, the differential stage 100 includes the intermediate stage.

The output node 2 of the first output stage 110 is connected via the switches SW32 and SW33 respectively to a connection node (node 10) of the capacitor C1 and an inverting input terminal (−) of the differential stage 100, and a connection node (node 9) of the capacitor C1 and the switch SW31. A non-inverting input terminal (+) of the differential stage 100 is connected to a node 1 and supplied with a reference voltage Vref (constant voltage). An output node 3 of the second output stage 120 is connected to a load 90 (data line).

Figure 12:
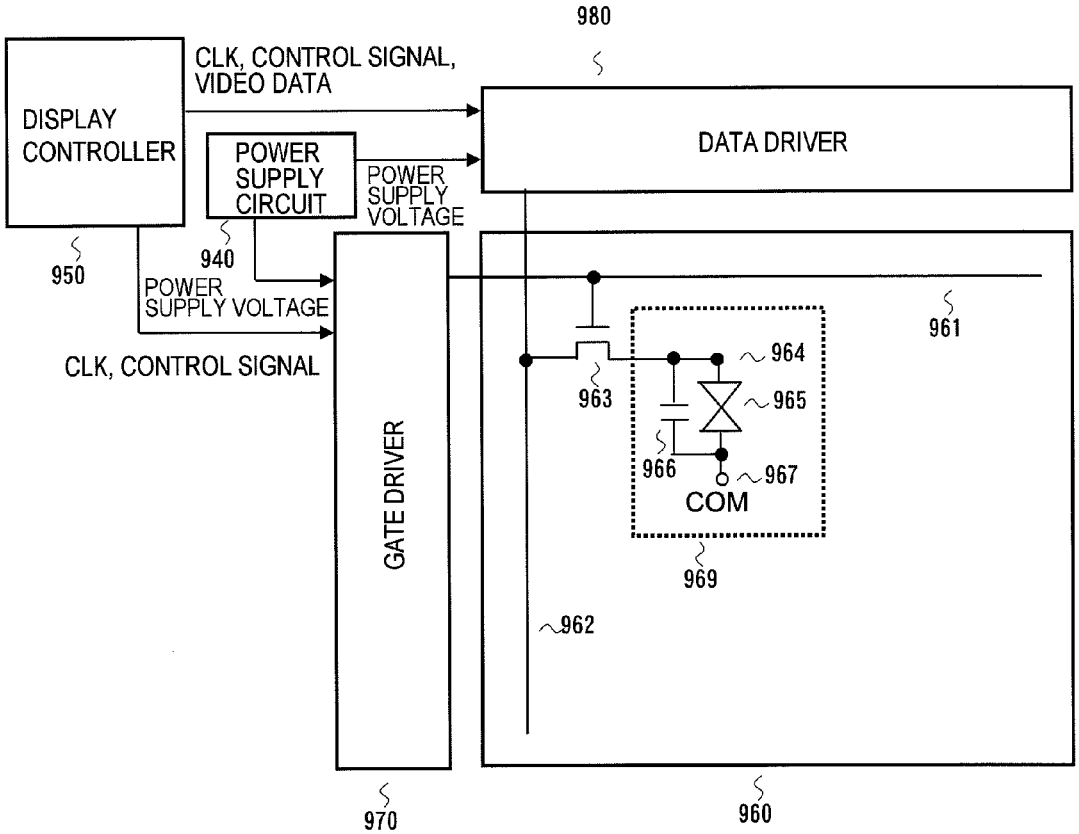
FIG. 12 is a diagram describing a liquid crystal display device.

Although not limited thereto, in the present embodiment, the output amplifier circuit drives a data line of an active matrix display panel, and the load 90 corresponds to a data line 962 in FIG. 12, for example. It is to be noted that in FIG. 1, the switches SW10, SW11, SW12, and a switch, not shown in the drawing, inside the second output stage 120, make up a connection control circuit (first switch unit) 510 that controls a connection mode of the output amplifier circuit, and are controlled to be conductive or non-conductive by control signals from the control signal generation circuit 500. The switches SW31, SW32, and SW33 form a second switch unit (connection control circuit) 520 that controls a connection mode of the output amplifier circuit, and are controlled to be ON (conductive) or OFF (non-conductive) by control signals from the control signal generation circuit 500. The second output stage 120 is also controlled to be activated or non-activated by a control signal from the control signal generation circuit 500.

Figure 2:
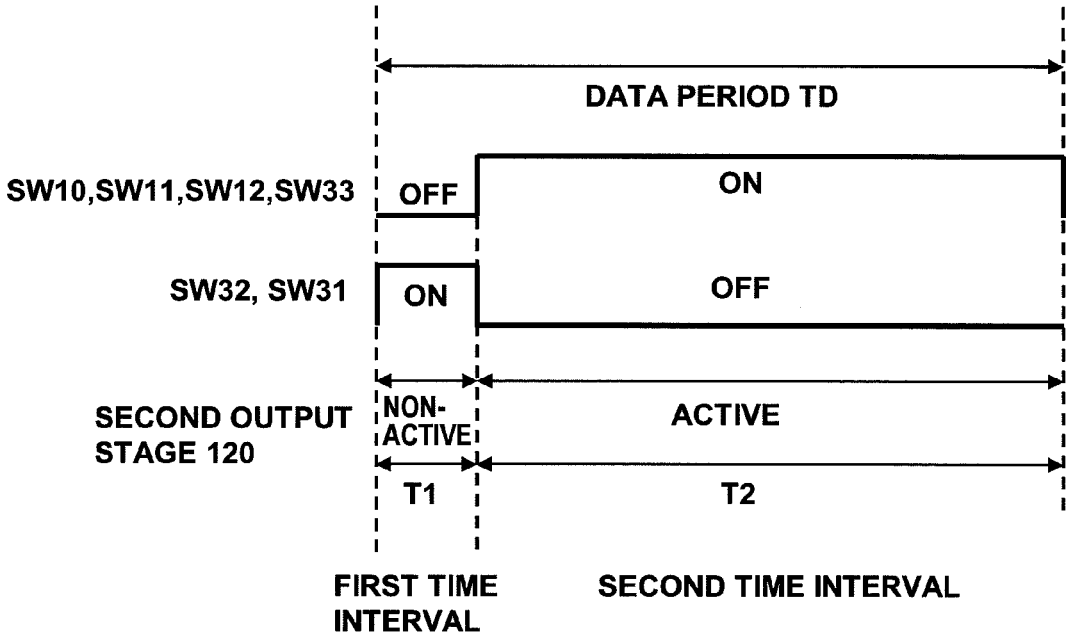
FIG. 2 is a diagram describing operation of the exemplary embodiment of the present invention.

FIG. 2 is a timing waveform diagram showing an example of operation of the output amplifier circuit of FIG. 1. In FIG. 2, first and second time intervals T1 and T2 are included in one data period (TD). In the first time interval T1, the first output stage 110 is activated, the second output stage 120 is non-activated, the switch SW10 is OFF, and an output amplifier circuit is cut off from the load 90. In the first time interval T1, the differential stage 100 and the first output stage 110 are made to operate, the switches SW31 and SW32 are turned ON and OFF, respectively, and a voltage difference between the voltage (Vref+Voff) of the node 10 including an output offset and an input voltage Va of the input terminal 8 is stored in the capacitor C1.

In the second time interval T2, the switches SW11 and SW12 are turned ON and hence the second output stage 120 has inputs 5 and 7 connected to the outputs 4 and 6 of the differential stage 100 and is activated. The switch SW10 is turned ON and hence the load 90 is driven at the same time by the first output stage 110 and the second output stage 120, which output a voltage corresponding to the input voltage Va with no output offset.

First Example

Figure 3:
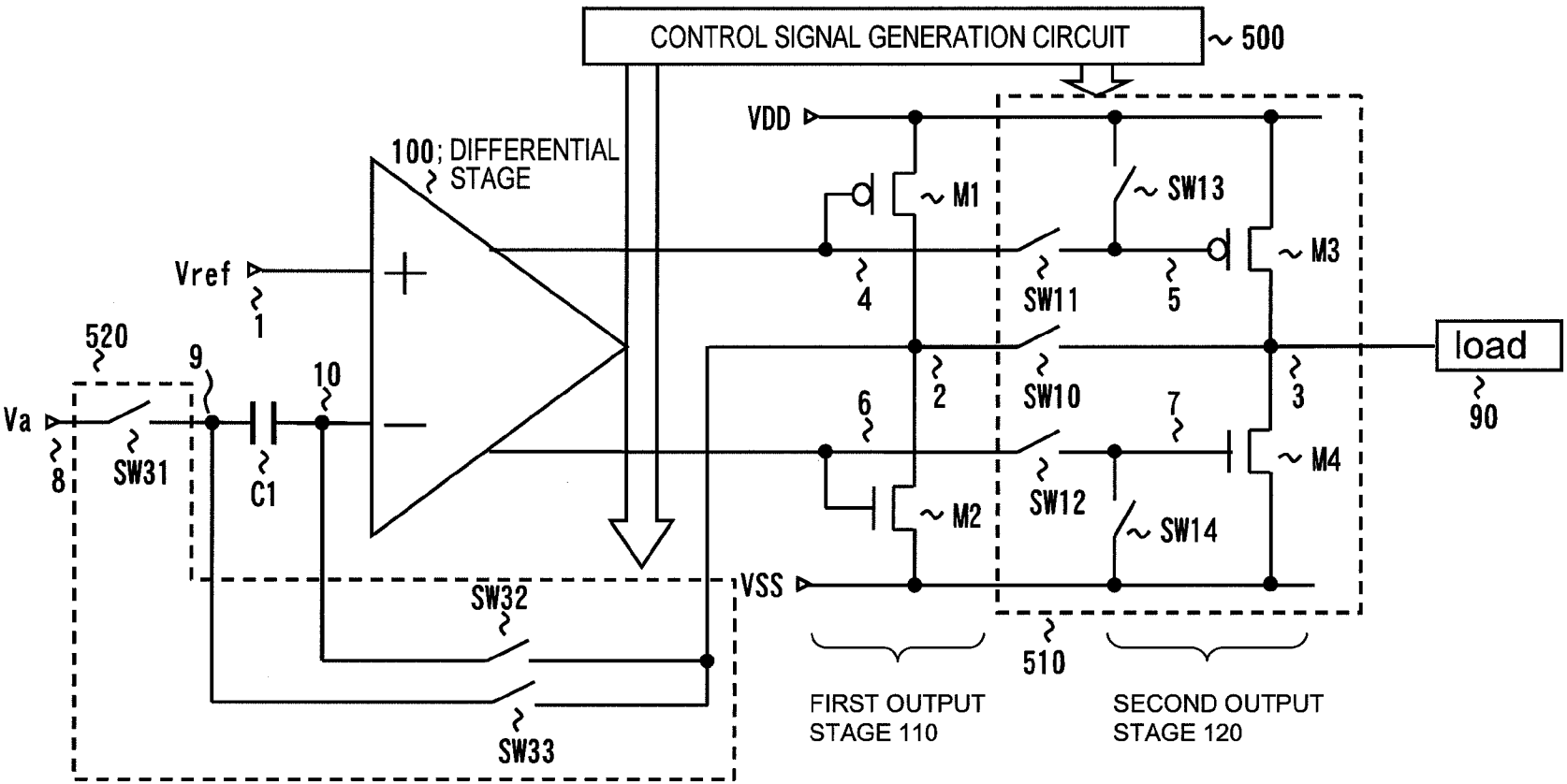
FIG. 3 is a diagram showing a configuration of a first example of the present invention.

FIG. 3 is a diagram showing a configuration of a first example of the present invention. FIG. 3 shows a circuit configuration of the first output stage 110 and the second output stage 120 of FIG. 1. Referring to FIG. 3, the first output stage 110 includes a pMOS transistor M1 and an nMOS transistor M2 connected in series between a power supply VDD and a power supply VSS. The pMOS transistor M1 has a source, gate, and drain connected to the power supply VDD, a first output 4 of the differential stage 100, and an output node 2, respectively. The nMOS transistor M2 has a source, gate, and drain connected to the power supply VSS, a second output 6 of the differential stage 100, and the output node 2, respectively.

The second output stage 120 includes a pMOS transistor M3 and an nMOS transistor M4 connected in series between the power supply VDD and the power supply VSS, and switches SW13 and SW14. The pMOS transistor M3 has a source connected to the power supply VDD, a gate (a first input 5 of the second output stage 120) connected via the switch SW13 to the power supply VDD, and connected via a switch SW11 to the output 4 of the differential stage 100, and a drain connected to an output node 3. The nMOS transistor M4 has a source connected to the power supply VSS, a gate (a second input 7 of the second output stage 120) connected via the switch SW14 to the power supply VSS, and connected via the switch SW12 to the output 6 of the differential stage 100, and a drain connected to an output node 3.

The pMOS transistor M3 and the nMOS transistor M4 are preferably designed to have threshold voltages, the absolute values of which are larger than those of the pMOS transistor M1 and the nMOS transistor M2, such that when an output voltage is stable, a charging operation of the pMOS transistor M3 and a discharging operation of the nMOS transistor M4 are stopped. A voltage between the output 6 of the differential stage 100 and the power supply potential VSS gives gate-to-source voltages of the nMOS transistors M2 and M4. In a case where the threshold voltage of the nMOS transistor M4 is larger than the threshold voltage of the nMOS transistor M2, a potential at the output 6 of the differential stage 100 when the output voltage is stable, assumes a value close to VSS to maintain the nMOS transistor M4 in an OFF state and the nMOS transistor M2 in an ON state.

A voltage between the output 4 of the differential stage 100 and the power supply potential VDD gives gate-to-source voltages of the pMOS transistors M1 and M3. In a case where an absolute value of the threshold voltage of the pMOS transistor M3 is larger than an absolute value of the threshold voltage of the pMOS transistor M1, a potential at the output 4 of the differential stage 100 when an output voltage is stable, assumes a value close to VDD to maintain the pMOS transistor M3 in an OFF state and the pMOS transistor M1 in an ON state.

Figure 4:
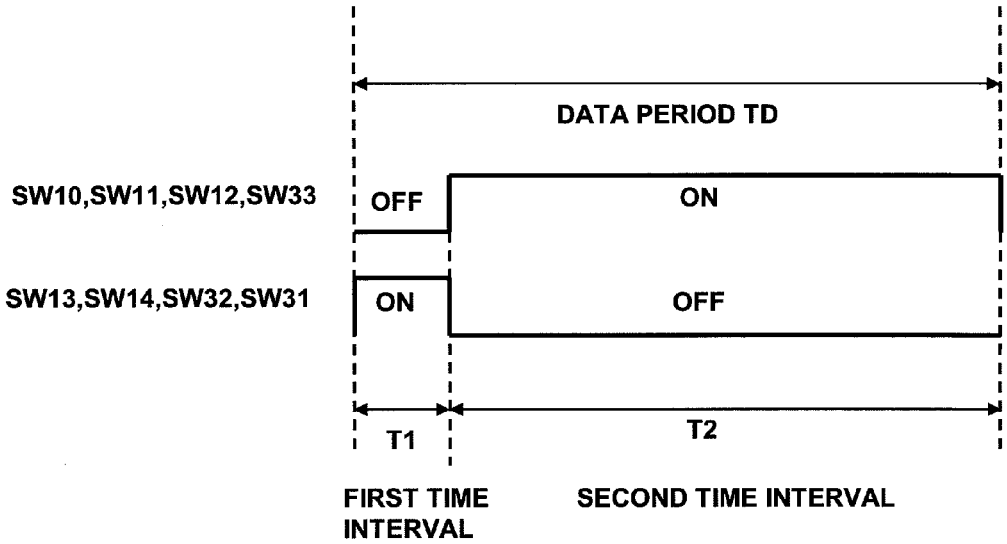
FIG. 4 is a diagram describing operation of the first example of the present invention.

FIG. 4 is a diagram describing the operation of switches of a circuit in FIG. 3. T1 and T2 in FIG. 4 are identical to T1 and T2 of FIG. 2. In a first time interval T1, the switches SW10, SW11, SW12, and SW33 are OFF, and the switches SW13, SW14, SW31, and SW32 are ON. The transistors M3 and M4 of the second output stage 120 are also OFF, and an output amplifier circuit is cut off from a load 90. In a first time interval T1, similar to the first time interval T1 of FIG. 2, the differential stage 100 and the first output stage (M1 and M2) are made to operate, and a voltage difference between a voltage (Vref+Voff) at a node 10 which includes an output offset and an input voltage Va at an input terminal 8 is stored in a capacitor C1.

In a second time interval T2, the switches SW10, SW11, SW12, and SW33 are ON, and the switches SW13, SW14, SW31, and SW32 are OFF. The first output stage (M1 and M2) and the second output stage (M3 and M4) receive differential outputs 4 and 6 of the differential stage 100, and drive the load 90. In the second time interval T2, similar to the second time interval T2 of FIG. 2, the differential stage 100, the first output stage (M1 and M2), and the second output stage (M3 and M4) are made to operate, the load 90 is driven at the same time, by the first output stage (M1 and M2) and the second output stage (M3 and M4), and a voltage corresponding to the input voltage Va with no output offset is outputted. It is to be noted that the first output stage (M1 and M2) drives the load 90 through the output switch SW10, but the second output stage (M3 and M4) drives the load 90 without going through the output switch SW10. By setting each transistor of the second output stage (M3 and M4) to a transistor size with sufficiently high drive capability, the load 90 is driven at high speed by the second output stage (M3 and M4) without being affected by ON resistance of the output switch. When the output voltage approaches a stable state, the operation of the second output stage (M3 and M4) is stopped, and only the first output stage (M1 and M2) in operation. It suffices that the first output stage (M1 and M2) has a drive capability to drive the load 90 close to a stable output state, and hence the transistor size of the first output stage (M1 and M2) can be decreased.

Figure 14:
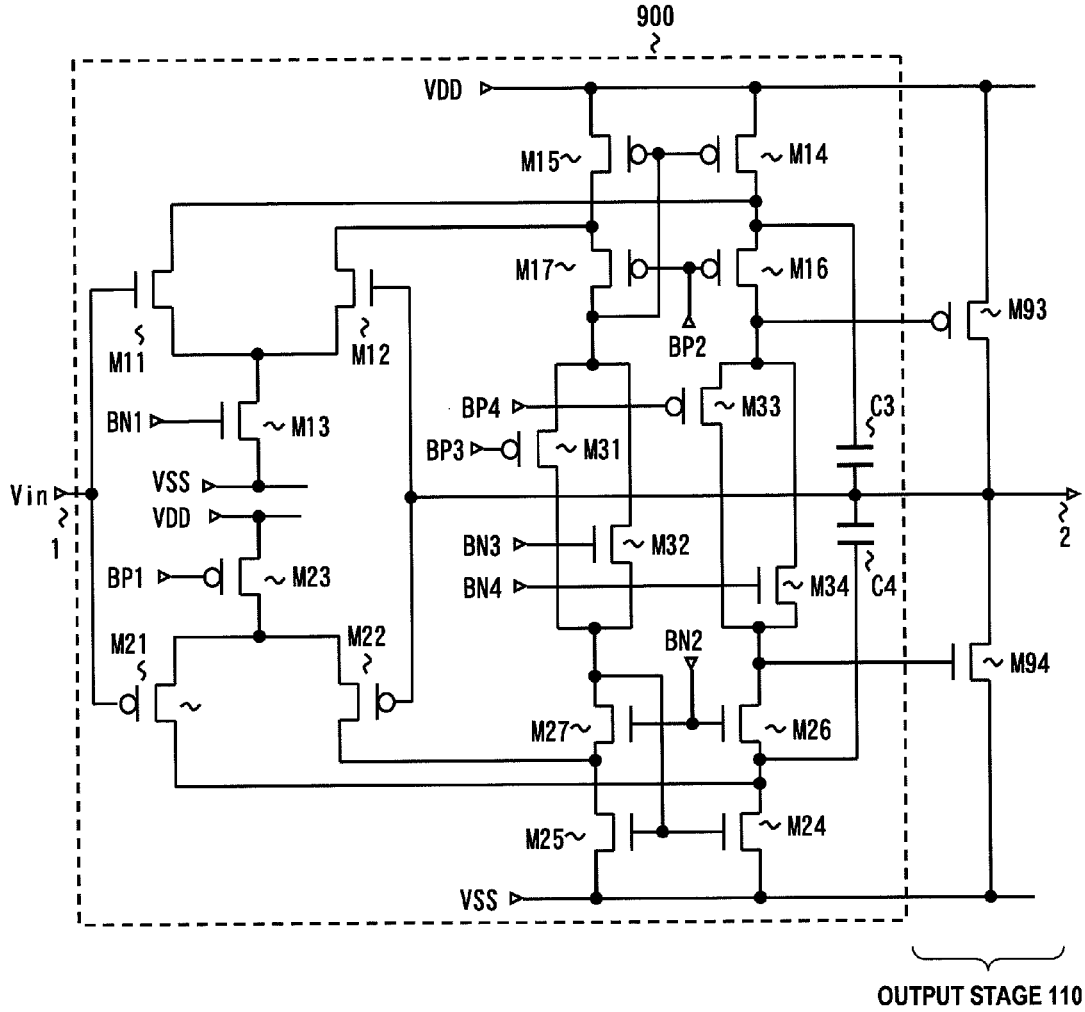
FIG. 14 RELATED ART
FIG. 14 is a diagram showing a configuration of FIG. 13A.
Figure 15:
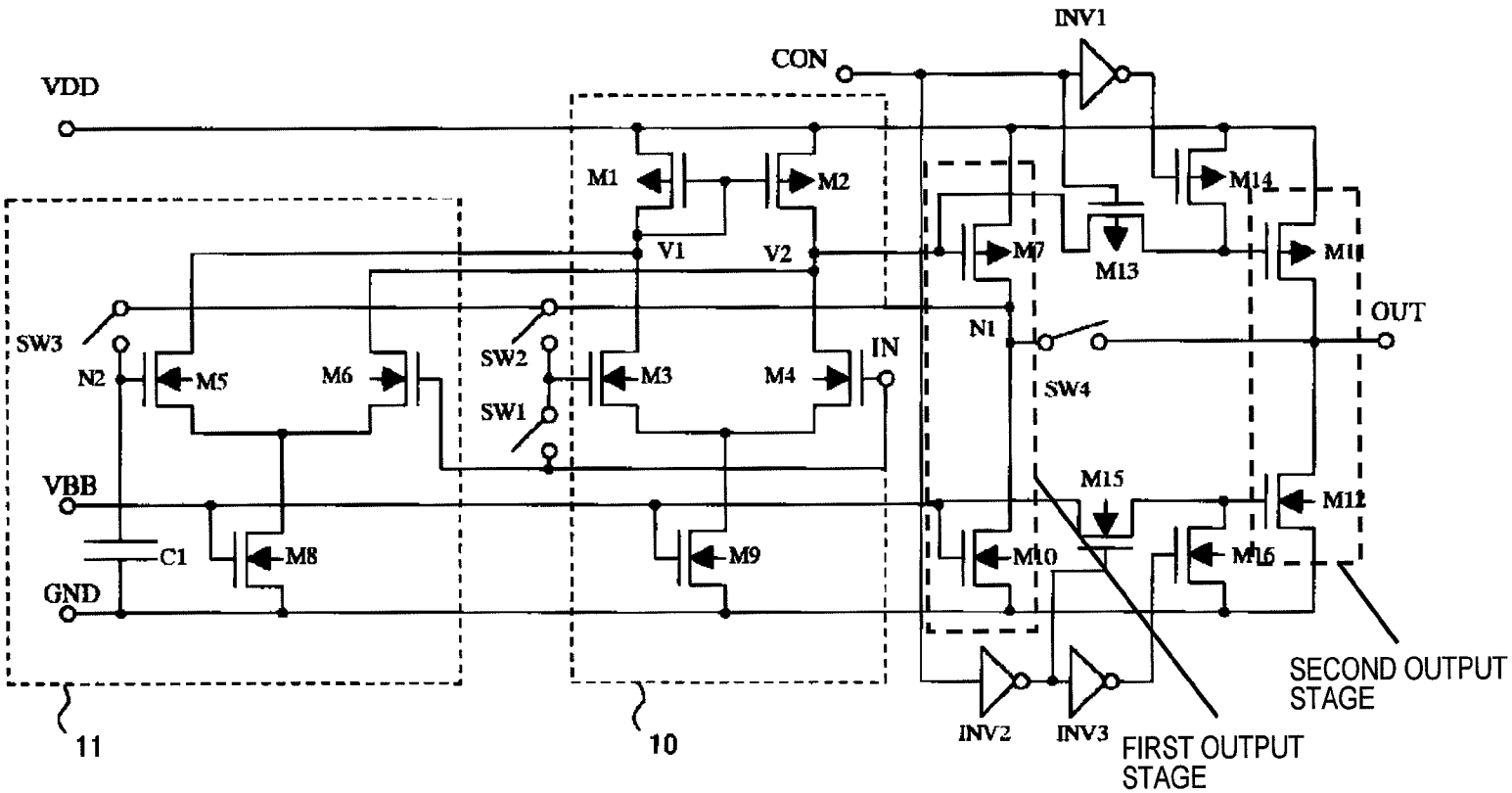
FIG. 15 RELATED ART
FIG. 15 is a diagram showing a configuration of a circuit described in Patent Document 2.

In the present example, the differential stage 100 can, as a matter of course, be configured by a differential stage 900 (folded cascade Rail-to-Rail differential circuit) of FIG. 14.

According to the present example, it is possible to improve drive speed, and to reduce power consumption that is consumed by the ON resistance of the output switch. High accuracy voltage output without an output offset is possible.

Second Example

Figure 5:
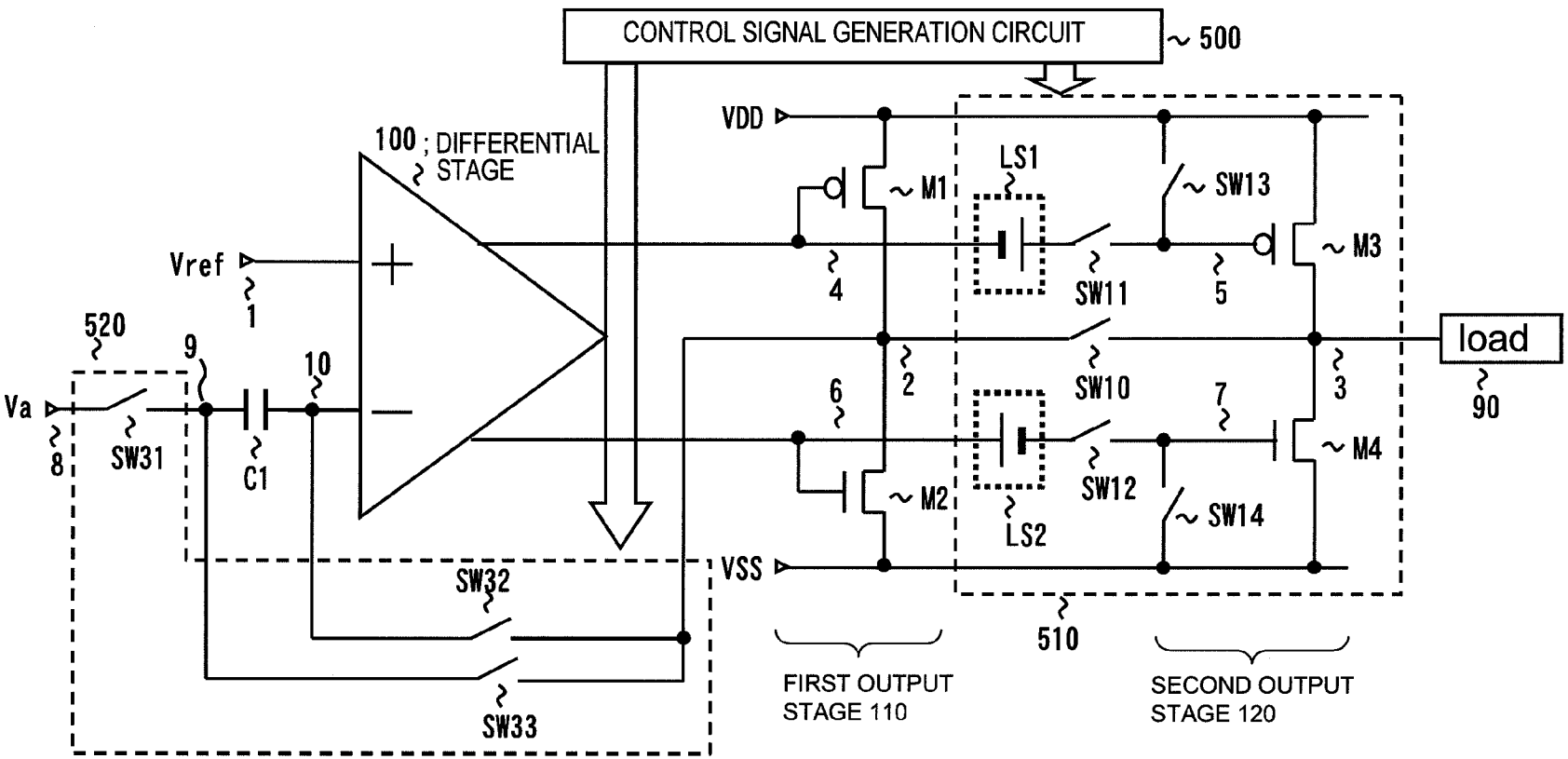
FIG. 5 is a diagram showing a configuration of a second example of the present invention.

Next, a description is given concerning a second example of the present invention. FIG. 5 is a diagram showing a configuration of the second example of the present invention. Referring to FIG. 5, in the present embodiment, there is further provided, with respect to a configuration of FIG. 3, a first level shift circuit LS1 connected in series with a switch SW11, between an output 4 of a differential stage 100 and an input 5 of a second output stage 120, and a second level shift circuit LS2 connected in series with a switch SW12, between an output 6 of the differential stage 100 and an input 7 of the second output stage. It is to be noted that in the present example, with regard to threshold voltages of respective transistors of a first output stage (M1 and M2) and the second output stage (M3 and M4), threshold voltages of transistors of the same conductivity type may be identical. Other than that, the configuration is identical to that of FIG. 3. A description is given below concerning points of difference from the first example described with reference to FIG. 3, with a description of similar portions being omitted.

When the switch SW11 is ON (second time interval T2 in FIG. 4), a node 5 has a higher potential than a node 4, due to the first level shift circuit LS1, and when the switch SW12 is ON (second time interval T2 in FIG. 4), a node 7 has a lower potential than a node 6, due to the second level shift circuit LS2. When output voltage is stable, voltage shift amounts of the first and second level shift circuits (LS1 and LS2) are set in order to stop operations of charging the pMOS transistor M3 and of discharging the nMOS transistor M4, of the second output stage 120. Operations of the first and second level shift circuits (LS1 and LS2) in the present example have an effect the same as that of an absolute value of threshold voltages of respective transistors of the second output stage (M3 and M4) being set higher than the first output stage (M1 and M2) with regard to FIG. 3.

Similar to the first example, in the present example also it is possible to improve drive speed and to reduce power consumption. High accuracy voltage output without an output offset is possible.

SECOND EXEMPLARY EMBODIMENT

Figure 6:
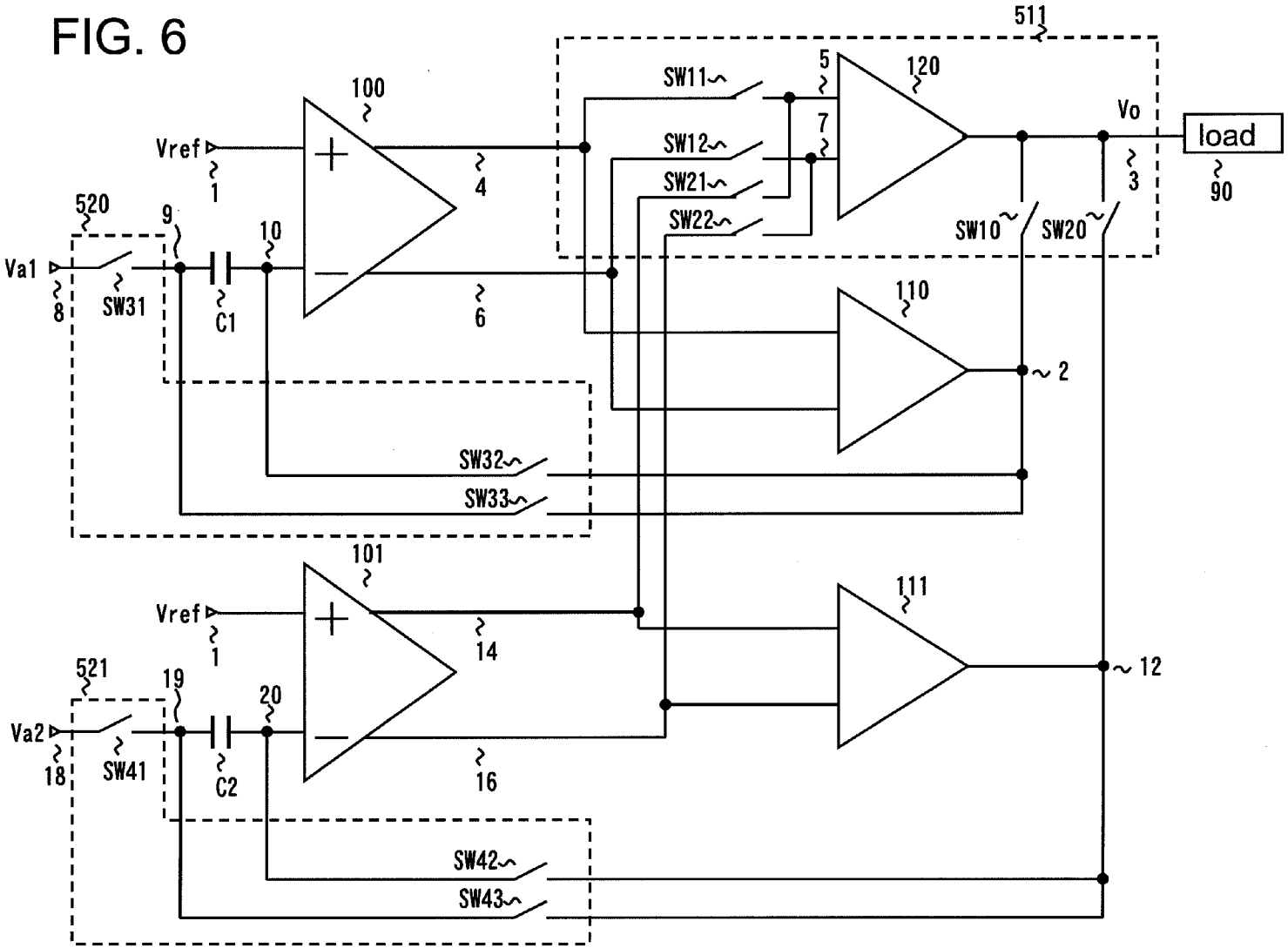
FIG. 6 is a diagram showing a configuration of a second exemplary embodiment of the present invention.

Next, a description is given concerning a second exemplary embodiment of the present invention. FIG. 6 is a diagram showing a configuration of the second exemplary embodiment of the present invention. Referring to FIG. 6, a differential stage 100, a first output stage 110, a second output stage 120, a capacitor C1, and switches SW10, SW11, SW12, SW31, SW32, and SW33 are the same as those of the first exemplary embodiment shown in FIG. 1. In the present exemplary embodiment, a differential stage 101, a first output stage 111, a capacitor C2, and switches SW20, SW21, SW22, SW41, SW42, and SW43 are added.

First and second outputs 14 and 16 of the differential stage 101, that has a non-inverting input terminal (+) supplied with a reference voltage Vref from a node 1 to, are connected, via the switches SW21 and SW22, to first and second inputs 5 and 7 of the second output stage 120. The differential outputs 14 and 16 of the differential stage 101 are connected to differential inputs of the first output stage 111. An output node 12 of the first output stage 111 is connected, via the switch SW20, to an output node 3. The output node 12 of the first output stage 111 is connected, via the switches SW43 and SW42, respectively, to a node 19 and an inverting input terminal 20 of the differential stage 101, that is, to each of two ends of the capacitor C2. An input terminal 18 is connected via the switch SW41 to the node 19. In the present exemplary embodiment, two sets of the first output stages 110 and 111 and a single second output stage 120 are provided, to perform switching of:

driving a load 90 by the first set of the differential stage 100 and the first output stage 110, and the second output stage 120, and driving the load 90 by the second set of the differential stage 101 and the first output stage 111, and the second output stage 120.

Figure 7:
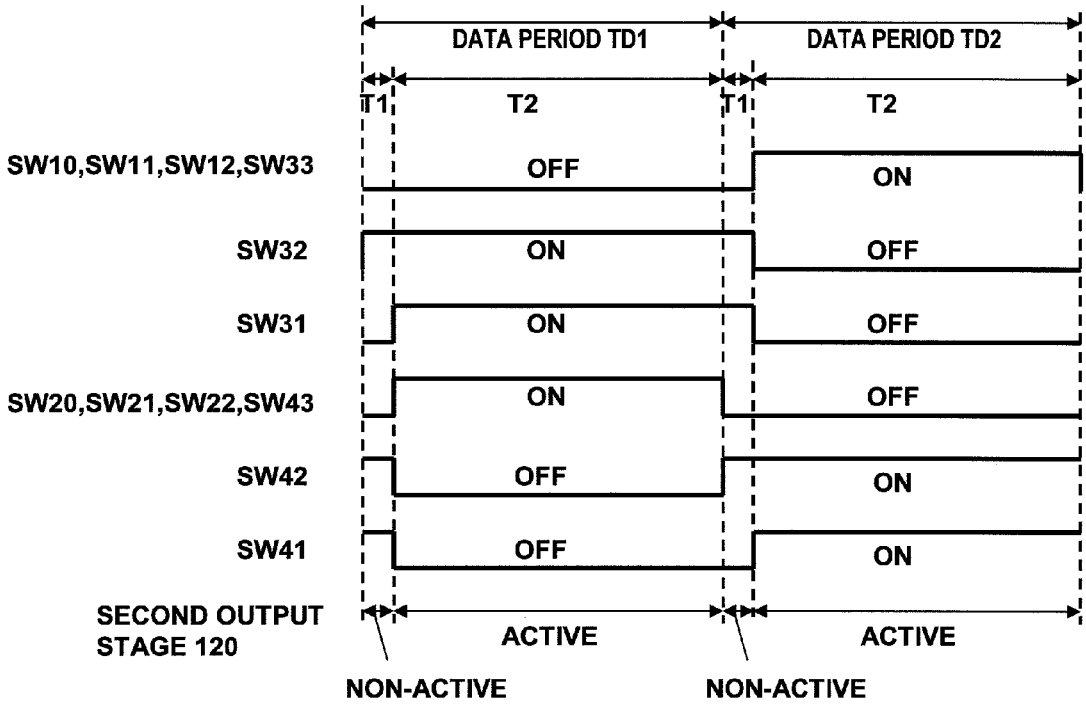
FIG. 7 is a diagram describing an example of operation of the second exemplary embodiment of the present invention.

FIG. 7 is a timing diagram for explaining an example of operation of FIG. 6. FIG. 7 shows first and second data periods (TD1 and TD2) having different switch control, and first and second time intervals (T1 and T2) are respectively included in the data periods. In the data period TD1, the load 90 is driven by the second set of the differential stage 101 and the first output stage 111, and the second output stage 120. In the data period TD1, in the first time interval T1, the switches SW41 and SW42 are ON (conductive), the switches SW20, SW21, SW22, and SW43 are OFF (non-conductive), a voltage obtained by adding a second output offset (Voff2) to the reference voltage Vref is applied to a node 20, and a voltage difference between an input voltage Va2 of an input terminal 18 and a voltage (Vref+Voff2) of the node 20 is stored across terminals of the capacitor C2. The second output stage 120 is made non-active, and an output amplifier circuit is cut off from the load 90.

In the second time interval T2, by having the switches SW41 and SW42 turned OFF (non-conductive), the switch SW43 turned ON (conductive), and the switches SW21, SW22, and SW20 turned ON (conductive), an output node 3 is driven by the first output stage 111 and the second output stage 120 that has been activated. With regard to a voltage outputted by the output node 3, the second output offset (Voff2) is cancelled, and a voltage corresponding to the input voltage Va2 is outputted.

It is to be noted that, in the data period TD1, the first set of differential stage 100 and the first output stage 110 do not contribute to driving the load 90, and perform only an operation of storing electric charge to the capacitor C1. That is, in the data period TD1, in the first time interval T1, the switch SW32 is ON (conductive), the switches SW31, SW10, SW11, SW12, and SW33 are OFF (non-conductive), and a voltage obtained by adding a first output offset (Voff1) to the reference voltage Vref is applied to a node 10. In the second time interval T2, the switches SW10, SW11, SW12, and SW33 are OFF (non-conductive), the switches SW32 and SW31 are ON (conductive), and a voltage difference between an input voltage Va1 of an input terminal 8 and a voltage (Vref+Voff1) of the node 10 is stored across terminals of the capacitor C1.

In the data period TD2, the load 90 is driven by the first set of the differential stage 100 and the first output stage 110, and the second output stage 120. In the data period TD2, in the first time interval T1, the switches SW31 and SW32 are ON (conductive), and the switches SW10, SW11, SW12, and SW33 are OFF (non-conductive), and witch statuses of the second time interval T2 of the data period TD1 is continued. Therefore, a voltage difference between an input voltage Va1 of the input terminal 8 and a voltage (Vref+Voff1) of the node 10 is stored in the capacitor C1. The second output stage 120 is made non-active, and the output amplifier circuit is cut off from the load 90.

In the second time interval T2, by having the switches S31 and SW32 turned OFF, the switch SW33 turned ON, and the switches SW11, SW12 and SW10 turned ON, an output node 3 is driven by the first output stage 110 and the second output stage 120 that has been activated. With regard to a voltage outputted by the output node 3, the first output offset (Voff1) is cancelled, and a voltage corresponding to the input voltage Va1 is outputted.

It is to be noted that, in the data period TD2, the second set of the differential stage 101 and the first output stage 110 do not contribute to driving the load 90, and perform only an operation of storing charge in the capacitor C2. That is, in the data period TD2, in the first time interval T1, the switch SW42 is ON (conductive), the switches SW41, SW20, SW21, SW22, and SW43 are OFF (non-conductive), and a voltage obtained by adding a second output offset (Voff2) to the reference voltage Vref is applied to the node 20. In the second time interval T2, the switches SW20, SW21, SW22, and SW43 are OFF (non-conductive), the switches SW42 and SW41 are ON (conductive), and a voltage difference between an input voltage Va2 of an input terminal 18 and a voltage (Vref+Voff2) of the node 20 is stored across terminals of the capacitor C2. This state is taken over by the first time interval T1 of a data period (not shown in the drawing) following the data period TD2.

Figure 8:
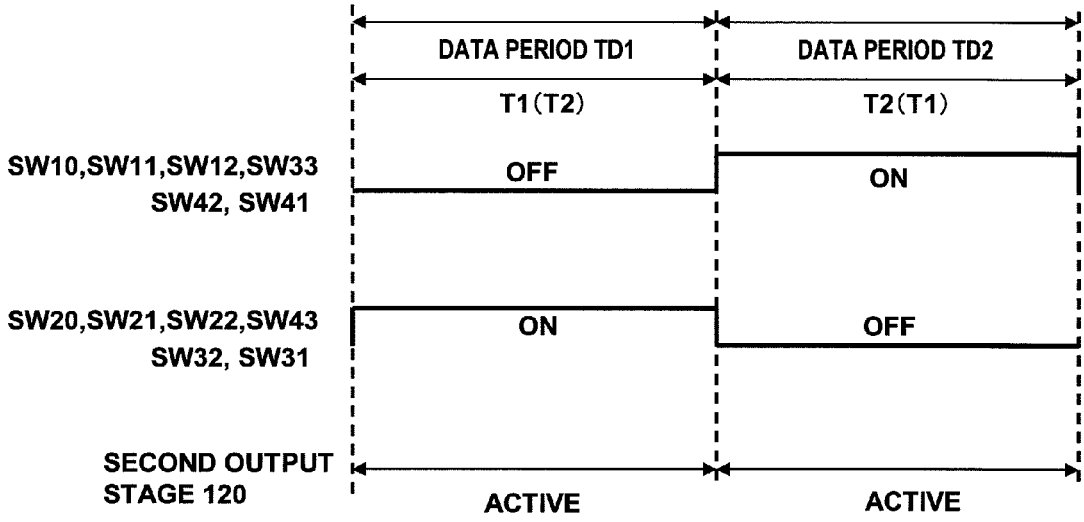
FIG. 8 is a diagram describing another example of operation of the second exemplary embodiment of the present invention.
Figure 13A:
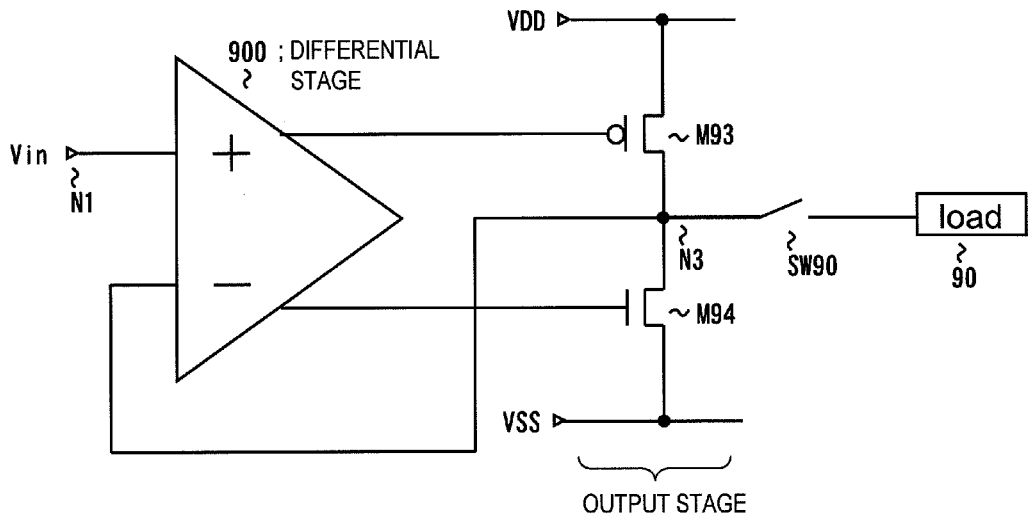
FIG. 13A RELATED ART
FIGS. 13A and 13B are drawings describing a configuration and operation of a circuit described in Patent Document 1.
Figure 13B:
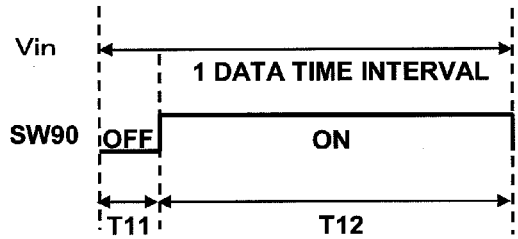
FIG. 13B RELATED ART

FIG. 8 is a timing diagram for describing another example of the operation of FIG. 6. FIG. 8 shows the first and second data periods (TD1 and TD2) that have different switch control. In FIG. 8, immediately after starting the data period, drive control is performed without cutting off the output amplifier circuit from the load 90. In FIG. 13B, a description was given that, in dot inversion driving, in order to prevent transition noise, a prescribed period from the start of one data period is normally controlled such that an output switch is OFF.

However, in recent years, with large increases in data line capacitance due to larger screen and high definition in a display device, and where drive frequency is increased in order to raise display quality of moving image support and the like, a method is adopted in which a horizontal time period of the same polarity is continued, and a polarity inversion cycle is lowered (for example, polarity inversion for each one frame), to perform driving. This is because, in the data period in which the same polarity continues, even when drive voltage swing is smaller and drive frequency is higher than in a data period accompanied by polarity inversion, it is possible to ensure a voltage writing rate of the data line (an actually attained voltage ratio with respect to a target voltage).

In order to further raise the voltage write rate of the data line, there is a trend to reduce or eliminate a transition noise prevention time period. This is because, by reducing drive voltage swing, there is a decrease to a small extent in transition noise, and a decrease in the voltage write rate of data line has a larger effect on a display, than the small extent of transition noise. A description is given of an operation example in a case where driving is performed without cutting off this type of output amplifier circuit and the load 90, making reference to FIG. 8.

In FIG. 8, two before/after data periods TD1 and TD2 fulfill effects of the first and second time intervals T1 and T2, respectively. That is, the second set of the differential stage 101 and the first output stage 111 perform an operation of the first time interval T1, in a data period (not shown in the drawing), one before the data period TD1. The operation of the second time interval T2 is performed in the data period TD1. The first set of the differential stage 100 and the first output stage 110 perform an operation of the first time interval T1, in the data period TD1. The operation of the second time interval T2 is performed in the data period TD2. The second output stage 120 is made active in each data period. In the data period TD1, the second output stage 120, together with the second set of the first output stage 111, drives with the load 90. In the data period TD2, the second output stage 120, together with the first set of the first output stage 110 drives the load 90. A specific description is given below concerning operation of the data periods TD1 and TD2.

In the data period TD1, the load 90 is driven by the second set of the differential stage 101 and the first output stage 111, and the second output stage 120, of FIG. 6. It is to be noted that in a data period one before the data period TD1, the same switch control as in the data period TD2 described later is performed, a voltage obtained by adding the second output offset (Voff2) to the reference voltage Vref is applied to the node 20, and a voltage difference between the input voltage Va2 of the input terminal 18 in response to input data of the data period one before, and a voltage (Vref+Voff2) at the node 20 is stored across terminals of the capacitor C2.

In the data period TD1, the switches SW41 and SW42 are OFF (non-conductive), the switch SW43 is ON (conductive), the switches SW21, SW22, and SW20 are ON, and the output node 3 is driven by the first output stage 111 and the second output stage 120. With regard to a voltage outputted by the output node 3, the second output offset (Voff2) is cancelled by a voltage stored in the capacitor C2 in a data period one before the data period TD1, and a voltage corresponding to the input voltage Va2 is outputted.

In the data period TD1, the first set of the differential stage 100 and the first output stage 110 do not contribute to driving the load 90, and perform only an operation of storing electric charge in the capacitor C1. That is, in the data period TD1, the switches SW10, SW11, SW12, and SW33 are OFF (non-conductive), the switches SW32 and SW31 are ON (conductive), a voltage obtained by adding the first output offset (Voff1) to the reference voltage Vref is applied to the node 10, and a voltage difference between the input voltage Va1 of the input terminal 8 in response to input data of the data period TD1 and a voltage (Vref+Voff1) of the node 10 is stored across terminals of the capacitor C1.

In the next data period TD2, the load 90 is driven by the first set of the differential stage 100 and the first output stage 110, and the second output stage 120. In the data period TD2, the switches SW31 and SW32 are OFF (non-conductive), the switch SW33 is ON (conductive), the switches SW11, SW12, and SW10 are ON (conductive), and the output node 3 is driven by the first output stage 110 and the second output stage 120. In a voltage outputted from the output node 3, the first output offset (Voff1) is cancelled by a voltage stored in the capacitor C1 in the data period TD1, and a voltage corresponding to the input voltage Va1 is outputted.

In the data period TD2, the second set of the differential stage 101 and the first output stage 111 do not contribute to driving the load 90, and perform only an operation of storing charge in the capacitor C2. That is, in the data period TD2, the switches SW20, SW21, SW22, and SW43 are OFF, the switches SW42 and SW41 are ON, a voltage obtained by adding the second output offset (Voff2) to the reference voltage Vref is applied to the node 20, and a voltage difference between the input voltage of the input terminal 18 in response to input data of the data period TD2 and a voltage (Vref+Voff2) of the node 20 is stored across terminals of the capacitor C2. The voltage stored in the capacitor C2 is taken over in the next data period (not shown in the drawing) following the data period TD2.

A description has been given above of two operation examples based on control shown in FIG. 7 and FIG. 8 by the output amplifier circuit of FIG. 6. However, in FIG. 6, it is possible to improve the drive speed of the load 90 by the second output stage 120 that is not affected by an ON resistance of the output switches SW10 and SW20, and also to reduce power consumption by drive current that drives the load 90 via the output switches SW10 or SW20 being reduced (reduction of consumption by the ON resistance of the output switches). A high accuracy voltage output, in which an output offset is cancelled, is possible.

It is to be noted that configurations of FIG. 3 and FIG. 5 can be applied to FIG. 6. That is, a setting may be made so that an absolute value of a threshold voltage of an output transistor (not shown in the drawing) of the second output stage 120 is larger than an absolute value of a threshold voltage of an output transistor (not shown in the drawing) of the first set of the first output stage 110 and the second set of the first output stage 111 (note that this relates to threshold voltages of transistors of the same conductivity type). Or, first and second level shift circuits (LS1 and LS2) of FIG. 5 may be provided in a front stage of an input of the second output stage 120. In this way, with regard to the second output stage 120, it is possible to drive the load 90 at high speed together with the first output stage 110 or 111 when output voltage is changed, and to stop the operation of the second output stage 120 when an output is stable.

Another feature of the two operation examples based on control in FIG. 7 and FIG. 8 by the output amplifier circuit of FIG. 6 is that a time period in which the voltage of the capacitor C1 or C2 is stored can be secured in approximately one data period. As a result, in FIG. 7, the first time interval T1 of each data period can be set to a minimum time period necessary for stopping transition noise, with no relation to voltage storing time period of the capacitor C1 or C2. In a control example in FIG. 2 of the output amplifier circuit of FIG. 1, and in a control example in FIG. 4 of the output amplifier circuit of FIG. 3, the voltage storing time period of the capacitor C1 must be took into account for the first time interval T1 of each data period.

In the example of control shown in FIG. 8, since the first and second time intervals T1 and T2 are not provided for each respective data period, the number of control signals is reduced and control is facilitated. However, the output amplifier circuit of FIG. 6 is provided with two sets of differential stage, first output stage, and capacitor, and since the number of switches increases, the area increases to some extent.

In a configuration of the output amplifier circuit of FIG. 6, since it is possible to adequately secure the voltage storing time period of the capacitor, an output amplifier circuit (sample and hold amplifier) of a serial DAC (digital-to-analog converter) is preferably used, although not limited thereto. In the serial DAC, there are provided two capacitor elements of the same capacitance, with a switch connected between first ends thereof and second ends being coupled together, a prescribed voltage in accordance with a bit of an input digital signal is applied to the first end of a first of the capacitors, electric charge is stored in the first of the capacitors, and by performing ON-OFF control of the switch, electric charge is re-distributed between the two capacitors. A time-division multiplexed voltage corresponding to a value of an input digital signal is stored in a second capacitor at a point in time at which all serial bits have been sequentially scanned.

In FIG. 6, for example, a configuration may be provided in which a capacitor C3 that performs charge redistribution with the capacitor C1 is added between the input terminal 8 and the node 10, and in the data period TD1, with the switch SW31 controlled as a switch that performs the charge redistribution, an output analog voltage of the serial DAC is sampled and held in the capacitor C1. A configuration may be provided in which a capacitor C4 that performs charge redistribution with the capacitor is added between the input terminal 18 and the node 20, and in the data period TD2, with the switch SW41 controlled as a switch that performs the charge redistribution, an output analog voltage of the serial DAC is sampled and held in the capacitor C2. In this case, control of each switch in FIG. 6, other than SW31 and SW41 may be similar to FIG. 7 or FIG. 8. By assigning approximately one data period to a time period, in which all serial data bits are sequentially scanned and a voltage is stored in the capacitor C1 or C2, it is possible to realize the output amplifier circuit of the serial DAC. In the serial DAC, when the number of bits of an input digital signal is increased, an area is not affected, and hence, even if the output amplifier circuit of FIG. 6 is provided with two sets of the differential stage and the first output stage, it is possible to reduce an area in a multi-bit driver in which the serial DAC and the output amplifier circuit of FIG. 6 are combined.

THIRD EXEMPLARY EMBODIMENT

Figure 9:
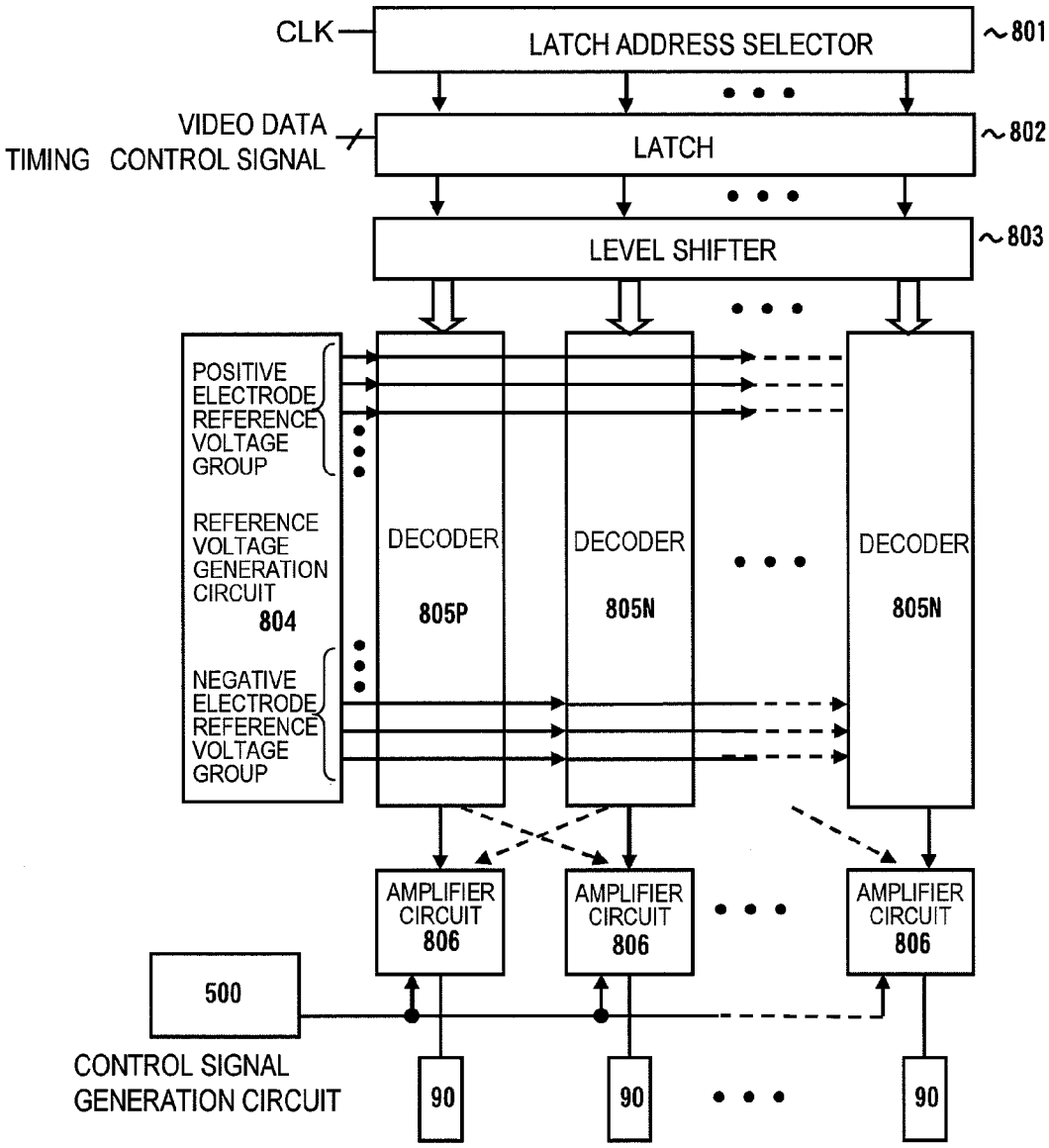
FIG. 9 is a diagram describing a configuration of a third exemplary embodiment of the present invention.

FIG. 9 is a diagram showing a configuration of a data driver of a liquid crystal display device provided with an output amplifier circuit as described above, with a main part of the data driver shown in blocks.

Referring to FIG. 9, the data driver includes a latch address selector 801, a latch 802, a level shifter 803, a reference voltage generation circuit 804, a positive polarity decoder 805P, a negative polarity decoder 805N, an output amplifier circuit 806, a control signal generation circuit 500, and a load (data line) 90 driven by the output amplifier circuit 806. The output amplifier circuit 806 includes an output amplifier circuit described with reference to FIG. 1 (including FIG. 3 and FIG. 5), and FIG. 6.

The latch address selector 801 determines data latch timing, based on a clock signal CLK. The latch 802 latches video digital data based on timing determined by the latch address selector 801, and outputs data to a decoder (the positive polarity decoder 805P, the negative polarity decoder 805N) via the level shifter 803 together in response to timing of a timing control signal. The latch address selector 801 and the latch 802 are logic circuits, and in general are configured by a low voltage (0 V to 3.3 V).

The reference voltage generation circuit 804 generates a positive polarity reference voltage group and a negative reference voltage group. The positive polarity decoder 805P is supplied with the positive reference voltage group, selects a reference voltage corresponding to input data, and outputs a positive polarity reference voltage. The negative polarity decoder 805N is supplied with the negative reference voltage group, selects a reference voltage corresponding to input data, and outputs a negative polarity reference voltage. Each output amplifier circuit 806 receives as input, reference voltages outputted respectively from the positive polarity decoder 805P and the negative polarity decoder 805N, and drives the load (data line) 90 by an output voltage that has undergone offset cancelling and operational amplification by a control signal from the control signal generation circuit 500. Since data lines of the liquid crystal display device takes different voltage polarities between neighboring lines, a positive polarity reference voltage and a negative polarity reference voltage from the positive polarity decoder 805P and the negative polarity decoder 805N switch the connection mode to two output amplifier circuits 806 that drive neighboring loads (data lines), based on a polarity signal, between straight output and cross-over output 90. The polarity signal is generated together with control signals of the output amplifier circuit 806 in the control signal generation circuit 500.

The control signal generation circuit 500 is provided in common for a plurality of the output amplifier circuits 806, and generates a plurality of control signals that control ON and OFF states of each switch arranged in the output amplifier circuits 806. Switching of connection modes (the first and the second time intervals T1 and T2) of the output amplifier circuits of FIG. 1 and FIG. 6 is performed by the plurality of control signals from the control signal generation circuits 500.

In a data driver of FIG. 9, a second output stage 120 is provided such that an output amplifier circuit 806 can drive the loads (data lines) 90 not going through an output switch, and it is possible to realize high speed driving with regard to a large capacity data line load, and to realize a reduction in power consumption and heat generation. High accuracy voltage output without an output offset is possible.

FOURTH EXEMPLARY EMBODIMENT

Figure 11:
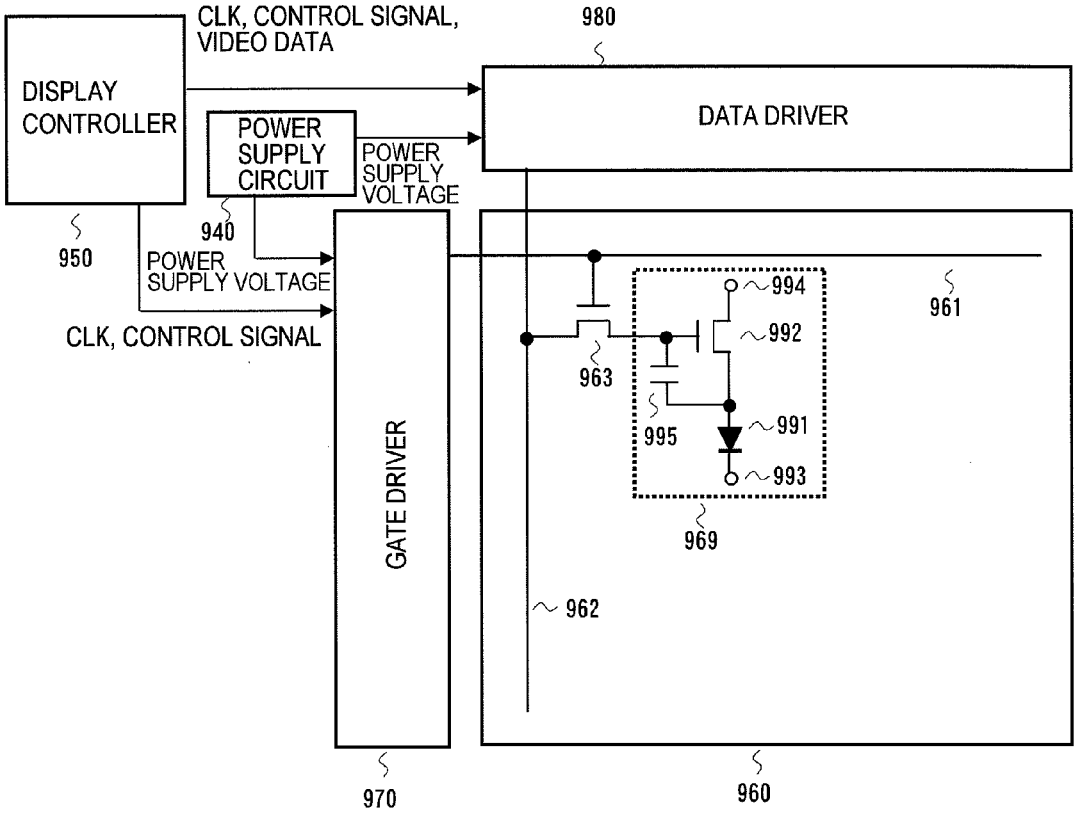
FIG. 11 is a diagram describing an organic EL display device.

An output amplifier circuit described with reference to FIG. 1 (including FIG. 3 and FIG. 5) and FIG. 6 can be applied not only to a data driver of a liquid crystal display device in FIG. 9, but also to a data driver of an organic EL (Electro-Luminescence) display device. First, referring to FIG. 11, an outline is given concerning a typical configuration of the organic EL display device that uses an active matrix drive system. In driving the organic EL display device, there is a current program method in which a current signal corresponding to gray scale is supplied to a data line, and a voltage program method in which a voltage signal corresponding to gray scale is supplied to a data line. The present invention can be applied to the voltage program method. In FIG. 11, a main configuration connected to one pixel of an organic EL display unit is schematically shown by an equivalent circuit. In FIG. 11, the configuration differs from a liquid crystal display device described with reference to FIG. 12 by having a display element 969, and other elements are basically the same as elements of FIG. 12.

In a display panel 960 of the organic EL display device of FIG. 11, a thin film transistor (TFT) 963 having a switching function, a thin film transistor (TFT) 992 that controls current supplied to an organic EL element, and an organic EL element 991 formed of an organic film sandwiched by two thin film electrode layers, are laid out in a matrix. The TFT 992 and the organic EL element 991 are connected in series between a power supply terminal 994 and a cathode electrode 993, and an auxiliary capacitor 995 that holds a control terminal voltage of the TFT 992 is further provided. The display element 969 corresponding to one pixel is configured by the TFT 992, the organic EL element 991, the power supply terminal 994, the cathode electrode 993, and the auxiliary capacitor 995.

The TFT 963, which has the switching function, are controlled to be ON (conductive) and OFF (non-conductive) by a scan signal. When the TFT 963 is ON (conductive), a gray scale signal voltage corresponding to a video data signal is applied to a control terminal of the TFT 992, a current corresponding to the gray scale signal voltage is supplied to the organic EL element 991 from the TFT 992, and the organic EL element 991 emits light in response to current supplied, to make a display. In FIG. 11, the configuration other than the display element 969 is practically the same as the configuration of the liquid crystal display device of FIG. 12, and other descriptions are omitted. In FIG. 11, an example of the TFTs 963 and 992 being n-channel transistors is shown, but a configuration is also possible in which TFTs 963 and 992 are p-channel transistors.

Figure 10:
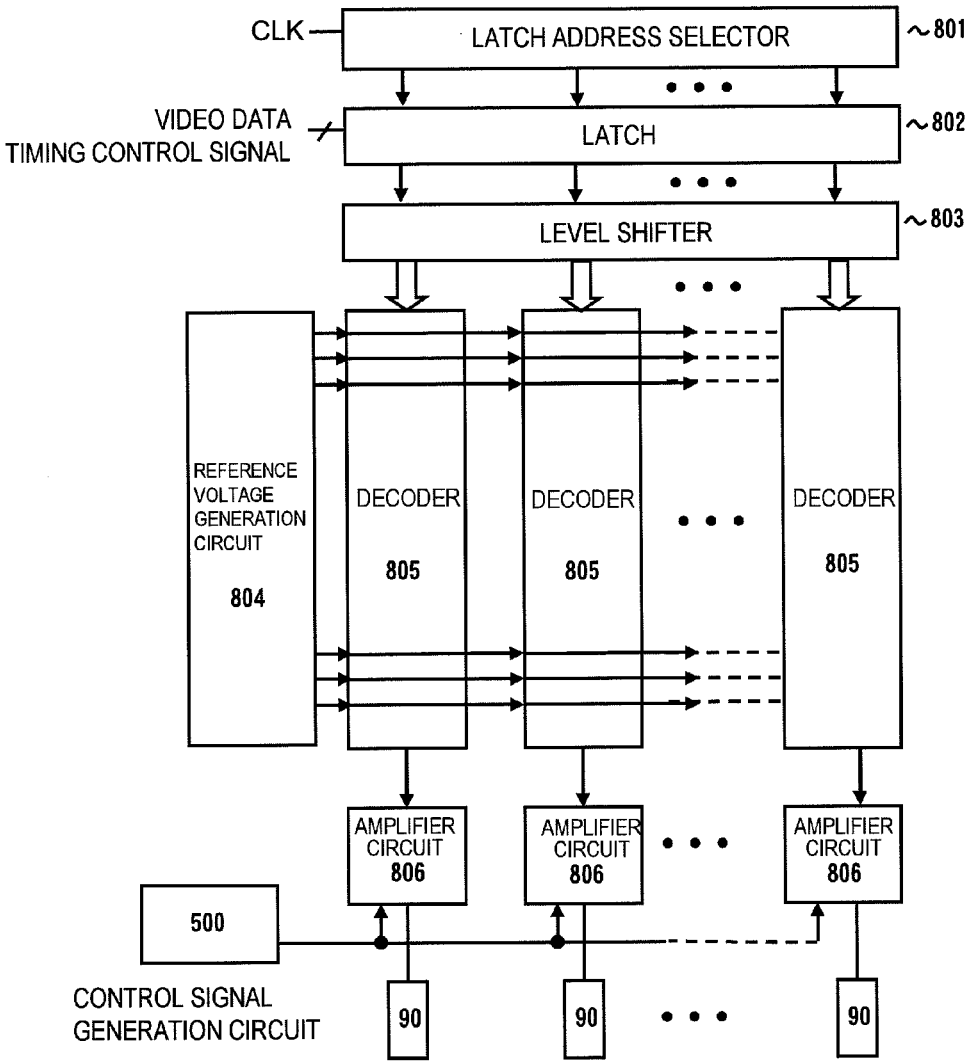
FIG. 10 is a diagram describing a configuration of a fourth exemplary embodiment of the present invention.

FIG. 10 is a diagram showing a configuration of a data driver of an organic EL display device provided with an output amplifier circuit of FIG. 1 and FIG. 6, with a main part of the data driver shown in a block diagram. With regard to the data driver of FIG. 10, configurations of a latch address selector 801, a latch 802, a level shifter 803, and an output amplifier circuit 806 are the same as those of the data driver of FIG. 9. In FIG. 10, a reference voltage generation circuit 804 and decoders 805 are different from the reference voltage generation circuit 804 and decoders 805 of FIG. 9.

In driving an organic EL display device, polarity inversion driving, which is necessary in driving a liquid crystal, is not necessary. Therefore, there is no polarity in the decoders 805, and thus the same decoder is provided for every output.

The reference voltage generation circuit 804 generates a reference voltage group corresponding to gray scale number and supplies the reference voltage group to each decode 805.

A decoder 805 selects a reference voltage corresponding to input data, to be outputted to the output amplifier circuit 806.

It is to be noted that when the organic EL element is configured by organic materials different for each of R, G, and B, the gray scale signal voltage may differ greatly for R, G, and B. In such a case, a configuration may be such that the reference voltage is generated for each of R, G, and B, by the reference voltage generation circuit 804, to be supplied to decoders 805 respectively corresponding to R, G, and B, and a reference voltage corresponding to input data is selected by the decoders 805 to be outputted to the output amplifier circuit 806.

The output amplifier circuit 806 receives the reference voltage form the decoder 805 and drives the load (data line) 90 by an output voltage that has undergone offset cancelling and operational amplification by a control signal from the control signal generation circuit 500.

In the data driver of FIG. 10 also, similar to FIG. 9, it is possible to realize high speed driving with regard to a large capacity data line load, and to realize a reduction in power consumption and heat generation. High accuracy voltage output without an output offset is possible.

It is to be noted that the various disclosures of the above-mentioned Patent Documents are incorporated herein by reference thereto. Modifications and adjustments of embodiments and examples are possible within the bounds of the entire disclosure (including the scope of the claims) of the present invention, and also based on fundamental technological concepts thereof. A wide variety of combinations and selections of various disclosed elements are possible within the scope of the claims of the present invention. That is, the present invention clearly includes every type of transformation and modification that a person skilled in the art can realize according the entire disclosure including the scope of the claims and to technological concepts thereof.

What is claimed is:

1. An output amplifier circuit comprising:

an input terminal that receives an input voltage;

a differential stage having a first input supplied with a reference voltage, a second input, and first and second outputs;

a first output stage having first and second inputs connected respectively to the first and second outputs of the differential stage;

a second output stage having first and second inputs and having an output connected to a load;

a capacitor element having a first end connected to the second input of the input pair of the differential stage; and a control circuit that controls switching between a first connection mode and a second connection mode, wherein the control circuit controls such that in the first connection mode, a non-conductive state is set between the first and second outputs of the differential stage and the first and second inputs of the second output stage, a non-conductive state is set between an output of the first output stage and the output of the second output stage, a conductive state is set between the output of the first output stage and the second input of the differential stage, and a conductive state is set between a second end of the capacitor element and the input terminal, the second end of the capacitor being supplied with the input voltage from the input terminal, and in the second connection mode, a conductive state is set between the first and second outputs of the differential stage and the first and second inputs of the second output stage;

a conductive state is set between the output of the first output stage and the output of the second output stage;

a non-conductive state is set between the output of the first output stage and the second input of the differential stage;

a non-conductive state is set between the second end of the capacitor element and the input terminal; and a conductive state is set between the output of the first output stage and the second end of the capacitor element.

2. The output amplifier circuit according to claim 1, wherein the control circuit controls such that in the first connection mode, the second output stage is set in a non-active state, and in the second connection mode, the second output stage is set in an active state.

3. The output amplifier circuit according to claim 1, wherein a time period required for the output amplifier circuit to drive the load in response to the input voltage includes:

a first time interval, and a second time interval after the first time interval, wherein the control circuit selects, in the first time interval, the first connection mode, and selects, in the second time interval, the second connection mode.

4. The output amplifier circuit according to claim 1, comprising:

a first switch connected between the first output of the differential stage and the first input of the second output stage;

a second switch connected between the second output of the differential stage and the second input of the second output stage;

a third switch connected between the output of the first output stage and the output of the second output stage;

a fourth switch connected between the input terminal and the second end of the capacitor element;

a fifth switch connected between the output of the first output stage and the second input of the differential stage; and a sixth switch connected between the output of the first output stage and the second end of the capacitor element, wherein the control circuit controls conductive and non-conductive states of the first to sixth switches.

5. The output amplifier circuit according to claim 4, wherein the control circuit controls such that in the first connection mode, the first, second, third, and sixth switches are set in a non-conductive state, and the fourth and fifth switches are set in a conductive state, and in the second connection mode, the first, second, third, and sixth switches to be set in a conductive state, and the fourth and fifth switches to be set in a non-conductive state.

6. The output amplifier circuit according to claim 1, wherein the input terminal, the differential stage, the first output stage, and the capacitor element form a first set, the output amplifier circuit further comprising a second set of an input terminal, a differential stage, a first output stage, and a capacitor element connected;

the differential stage of the second set having an input pair with a first input supplied with the reference voltage;

the capacitor element of the second set having one end connected to the second input of the input pair of the differential stage of the second set, the second output stage being provided for the first and second sets, the control circuit controlling switching among the first connection mode, the second connection mode, a third connection mode and a fourth connection mode, wherein the control circuit controls such that in the first connection mode, a non-conductive state is set between the first and second outputs of the differential stage of the first set and the first and second inputs of the second output stage, a non-conductive state is set between an output of the first output stage of the first set and the output of the second output stage, a conductive state is set between the output of the first output stage of the first set and the second input of the differential stage of the first set, and a conductive state is set between a second end of the capacitor element of the first set and the input terminal of the first set, the second end of the capacitor of the first set being supplied with the input voltage from the input terminal of the first set, in the second connection mode, a conductive state is set between the first and second outputs of the differential stage of the first set and the first and second inputs of the second output stage;

a conductive state is set between the output of the first output stage of the first set and the output of the second output stage;

a non-conductive state is set between the output of the first output stage of the first set and the second input of the differential stage of the first set;

a non-conductive state is set between the second end of the capacitor element of the first set and the input terminal of the first set; and a conductive state is set between the output of the first output stage of the first set and the second end of the capacitor element of the first set, in the third connection mode, a non-conductive state is set between the first and second outputs of the differential stage of the second set and the first and second inputs of the second output stage, a non-conductive state is set between an output of the first output stage of the second set and the output of the second output stage, a conductive state is set between the output of the first output stage of the second set and the second input of the differential stage of the second set, and a conductive state is set between a second end of the capacitor element of the second set and the input terminal of the second set, the second end of the capacitor of the second set being supplied with the input voltage from the input terminal of the second set, in the fourth connection mode, a conductive state is set between the first and second outputs of the differential stage of the second set and the first and second inputs of the second output stage;

a conductive state is set between the output of the first output stage of the second set and the output of the second output stage;

a non-conductive state is set between the output of the first output stage of the second set and the second input of the differential stage of the second set;

a non-conductive state is set between the second end of the capacitor element of the second set and the input terminal of the second set; and a conductive state is set between the output of the first output stage of the second set and the second end of the capacitor element of the second set.

7. The output amplifier circuit according to claim 6, wherein, when the first set of the differential stage, the first output stage, and the capacitor element are in the second connection mode and operate together with the second output stage that is activated, the second set of the differential stage, the first output stage, and the capacitor element are in the third connection mode, and when the second set of the differential stage, the first output stage, and the capacitor element are in the fourth connection mode and operate together with the second output stage that is activated, the first set of the differential stage, the first output stage, and the capacitor element are in the first connection mode.

8. A data driver comprising the output amplifier circuit according to claim 1, the data driver driving, as a load, a data line of a display device comprising a unit pixel having a pixel switch and a display element at an intersection of the data line and a scan line.

9. A display device comprising a plurality of data lines extending in parallel to each other in a first direction;

a plurality of scan lines extending in parallel to each other in a direction perpendicular to the first direction; and a plurality of display elements laid out in a matrix at intersections of the plurality of data lines and the plurality of scan lines;

a plurality of transistors, each having an input of one of a drain and a source connected to a terminal of a corresponding display element, an input of another of the drain and the source connected to a corresponding data line, and a gate connected to a corresponding scan line;

a gate driver that supplies scan signals respectively to the plurality of scan lines; and a data driver that supplies gray scale signals corresponding to input data respectively to the plurality of data lines; wherein the data driver comprises the data driver according to claim 8.

10. An output amplifier circuit comprising:

an input terminal that receives an input voltage;

an output terminal that outputs an output voltage;

a differential stage having a non-inverting input terminal supplied with a reference voltage and an inverting terminal and having first and second outputs;

a first output stage having first and second inputs connected to the first and second outputs of the differential stage, respectively;

a second output stage having first and second inputs and having an output connected to the output terminal;

a first switch connected between the first output of the differential stage and the first input of the second output stage;

a second switch connected between the second output of the differential stage and the second input of the second output stage;

a third switch connected between an output of the first output stage and the output of the second output stage;

a capacitor element having a first end connected to the inverting input terminal of the differential stage;

a fourth switch connected between the input terminal that receives an input voltage and a second end of the capacitor element;

a fifth switch connected between the output of the first output stage and the first end of the capacitor element;

a sixth switch connected between the output of the first output stage and the second end of the capacitor element; and a control circuit that controls conductive and non-conductive states of the first to sixth switches.

11. The output amplifier circuit according to claim 10, wherein a time period required for the output amplifier circuit to output an output voltage in response to the input voltage from the output terminal, includes a first time interval, and a second time interval, wherein the control circuit controls such that in the first time interval, the first, second, third, and sixth switches are set in a non-conductive state, and the fourth and fifth switches are in a conductive state, and that in a second time interval, the first, second, third, and sixth switches are set in a conductive state, and the fourth and fifth switches are set in a non-conductive state.

12. The output amplifier circuit according to claim 10, comprising:

a first power supply terminal supplied with a first power supply potential; and a second power supply terminal supplied with a second power supply potential, wherein the first output stage comprises first and second transistors connected in series between the first power supply terminal and the second power supply terminal, the first and second transistors having control terminals forming the first and second inputs of the first output stage, and being connected to the first and second outputs of the differential stage, respectively, and wherein the second output stage comprises third and fourth transistors connected in series between the first power supply terminal and the second power supply terminal, the third and fourth transistors having control terminals forming the first and second inputs of the second output stage, respectively, a connection node of the first and second transistors forming an output node of the first output stage, a connection node of the third and fourth transistors forming an output node of the second output stage, the first switch being connected between the control terminal of the first transistor and the control terminal of the third transistor, the second switch being connected between the control terminal of the second transistor and the control terminal of the fourth transistor, and the third switch being connected between a connection node of the first and second transistors and a connection node of the third and fourth transistors.

13. The output amplifier circuit according to claim 12, further comprising:

a seventh switch connected between the first power supply terminal and a control terminal of the third transistor, and an eighth switch connected between the second power supply terminal and a control terminal of the fourth transistor, wherein the control circuit controls such that when the seventh switch is in a conductive state, the third transistor is in a non-conductive state, and that when the eighth switch is in a conductive state the fourth transistor is in a non-conductive state.

14. The output amplifier circuit according to claim 13, wherein a time period required for the output amplifier circuit to output an output voltage in response to the input voltage from the output terminal, includes a first time interval, and a second time interval, wherein the control circuit controls such that in the first time interval, the first to third switches and the sixth switch are set in a non-conductive state, and the fourth and fifth switches and the seventh and eighth switches are set in a conductive state to set the third and fourth transistors in a non-conductive state, and in the second time interval, the first to third switches and the sixth switch are set in a conductive state, and the fourth and fifth switches and the seventh and eighth switches are set in a non-conductive state.

15. The output amplifier circuit according to claim 12, wherein an absolute value of a threshold voltage of the third transistor of the second output stage is larger than an absolute value of a threshold voltage of the first transistor of the first output stage, and an absolute value of a threshold voltage of the fourth transistor of the second output stage is larger than an absolute value of a threshold voltage of the second transistor of the first output stage.

16. The output amplifier circuit according to claim 12, comprising:

a first level shift circuit connected in series with the first switch between a connection node of a control terminal of the first transistor of the first output stage and the first output of the differential stage, and the control terminal of the third transistor of the second output stage;

a second level shift circuit in series with the second switch, between a connection node of a control terminal of the second transistor of the first output stage and the second output of the differential stage, and the control terminal of the fourth transistor of the second output stage.

17. The output amplifier circuit according to claim 16, wherein, when an output voltage of the second output stage reaches a voltage corresponding to the input voltage supplied to the second end of the capacitor element, the second output stage goes from an active state to a non-active state.

18. The output amplifier circuit according to claim 10, wherein the input terminal, the differential stage, the first output stage, and the capacitor element form a first set, the output amplifier circuit further comprising a second set of an input terminal, a differential stage, a first output stage, and a capacitor element connected, the differential stage of the second set having an input pair with a first input supplied with the reference voltage;

the capacitor element of the second set having one end connected to the second input of the input pair of the differential stage of the second set, the second output stage being provided for the first and second sets, the first and second switches respectively connected between first and second outputs of the differential stage of the first set, and first and second inputs of the second output stage;

the third switch connected between the output of the first output stage of the first set and the output of the second output stage;

the fourth switch connected between the input terminal of the first set and a second end of the capacitor element of the first set;

the fifth switch connected between the output of the first output stage of the first set and the first end of the capacitor element of the first set;

the sixth switch connected between the output of the first output stage of the first set and the second end of the capacitor element of the first set;

seventh and eighth switches respectively connected between first and second outputs of the differential stage of the second set and first and second inputs of the second output stage;

a ninth switch connected between an output of the first output stage of the second set and the output of the second output stage;

a tenth switch connected between the input terminal of the second set and the second end of the capacitor element of the second set;

an eleventh switch connected between an output of the first output stage of the second set and the first end of the capacitor element of the second set; and a twelfth switch connected between the output of the first output stage of the second set and the second end of the capacitor element of the second set.

19. The output amplifier circuit according to claim 18, wherein a time period required for driving a load in accordance with an input voltage of the input terminal of the second set includes a first and a second time interval, wherein the control circuit controls such that, in the first time interval, the first, second, third, and sixth switches and the fourth switch are set in a non-conductive state, the fifth switch is set in a conductive state, the seventh, eighth, ninth, and twelfth switches are set in a non-conductive state, and the tenth and eleventh switches are in a conductive state, and in the second time interval, the first, second, third, and sixth switches are set in a non-conductive state, the fourth and fifth switches are set in a conductive state, the seventh, eighth, ninth, and twelfth switches are set in a conductive state, and the tenth and eleventh switches are set in a non-conductive state, and, wherein a time period for driving the load in accordance with an input voltage of the input terminal of the first set includes a third and a fourth time interval, wherein the control circuit controls such that, in the third time interval, the first, second, third, and sixth switches are set in a non-conductive state, the fourth and fifth switches are set in a conductive state, the seventh, eighth, ninth, and twelfth switches and the tenth switch are set in a non-conductive state, and the eleventh switch is set in a conductive state, and in the fourth time interval, the first, second, third, and sixth switches are set in a conductive state, the fourth and fifth switches are set in a non-conductive state, the seventh, eighth, ninth, and twelfth switches are set in a non-conductive state, and the tenth and eleventh switches are set in a conductive state.

20. The output amplifier circuit according to claim 18, wherein the control circuit alternately repeats a first time interval in which the first, second, third, and sixth switches and the tenth and eleventh switches are in a non-conductive state, and the seventh, eighth, ninth, and twelfth switches and the fourth and the fifth switches are in a conductive state, and a second time interval in which the first, second, third, and sixth switches and the tenth and eleventh switches are in a conductive state, and the seventh, eighth, ninth, and twelfth switches and the fourth and the fifth switches are in a non-conductive state.

* * * * *